US009456641B1

(12) United States Patent
Mignone

(10) Patent No.: US 9,456,641 B1
(45) Date of Patent: Oct. 4, 2016

(54) YOGA ARTICLE OF CLOTHING AND METHOD OF USE THEREOF

(71) Applicant: Francesco Mignone, Tuckahoe, NY (US)

(72) Inventor: Francesco Mignone, Tuckahoe, NY (US)

( * ) Notice: Subject to any disclaimer, the term of this patent is extended or adjusted under 35 U.S.C. 154(b) by 847 days.

(21) Appl. No.: 13/645,679

(22) Filed: Oct. 5, 2012

Related U.S. Application Data

(60) Provisional application No. 61/543,969, filed on Oct. 6, 2011.

(51) Int. Cl.
*A41D 13/00* (2006.01)

(52) U.S. Cl.
CPC ..... *A41D 13/0015* (2013.01)

(58) Field of Classification Search
CPC ..... A41D 13/0015; A41D 13/065; A41D 13/05; A41D 13/0587; A41D 2400/80
See application file for complete search history.

(56) References Cited

U.S. PATENT DOCUMENTS 907,050 A * 12/1908 Hestness ..... 2/23
2,063,469 A * 12/1936 Smith ..... 2/94
2,302,368 A * 11/1942 Evans ..... 2/94
2,831,196 A 4/1958 Scheiber
2,948,898 A 8/1960 Allen
2,986,740 A 6/1961 Schudson
3,338,776 A 8/1967 Blair
3,526,229 A 9/1970 Blair
3,587,114 A * 6/1971 McCoutrie ..... 2/67
3,823,712 A 7/1974 Morel
4,149,274 A * 4/1979 Garrou et al. ..... 2/239
4,273,216 A 6/1981 Weissmann
4,688,269 A * 8/1987 Maeshima ..... 2/456
4,698,847 A 10/1987 Yoshihara
4,730,625 A 3/1988 Fraser et al.
4,731,882 A 3/1988 Ekman
4,810,559 A * 3/1989 Fortier et al. ..... 428/161
4,843,654 A * 7/1989 March ..... A41D 1/086 2/227
4,862,523 A 9/1989 Lipov
4,910,802 A 3/1990 Malloy
4,911,439 A 3/1990 Kuhl
4,945,571 A 8/1990 Calvert
4,946,453 A * 8/1990 Monson ..... 604/312
4,953,856 A 9/1990 Fox, III
4,993,705 A 2/1991 Tolle
5,007,412 A 4/1991 DeWall
5,014,358 A 5/1991 Matumori
5,046,194 A 9/1991 Alaniz et al.
5,088,728 A 2/1992 Deden
5,149,099 A 9/1992 Radakovich
5,179,942 A 1/1993 Drulias et al.
5,201,074 A 4/1993 Dicker
5,210,877 A * 5/1993 Newman ..... 2/456
5,282,277 A 2/1994 Onozawa
5,306,222 A 4/1994 Wilkinson
5,337,418 A * 8/1994 Kato et al. ..... 2/456
5,351,340 A 10/1994 Aldridge (Continued)

*Primary Examiner* — Richale Quinn
(74) *Attorney, Agent, or Firm* — Steven M. Hoffberg, Esq.; Ostrolenk Faber LLP

(57) ABSTRACT

Yoga apparel for assisting the wearer in performing and holding certain poses during the performance of Yoga exercise. The apparel has grips or strips of a friction-enhancing material, such as a rubber or textured surface material. The grips or strips are selectively provided in positions where a retention of body contact with a limb is desired. The grips or strips preferably have enhanced friction against both skin and normal apparel fabric, in both a dry and moistened state.

20 Claims, 19 Drawing Sheets

(56) References Cited

U.S. PATENT DOCUMENTS 5,367,708 A 11/1994 Fujimoto
5,402,742 A 4/1995 Kiaulehn
5,410,755 A 5/1995 Obujen
5,445,601 A 8/1995 Harlow
5,451,060 A 9/1995 Dalbo
5,518,481 A 5/1996 Darkwah
5,536,246 A 7/1996 Saunders
5,537,690 A 7/1996 Johnson
5,542,123 A 8/1996 DiPietro
5,570,472 A 11/1996 Dicker
5,582,583 A 12/1996 Ballantyne
5,591,122 A 1/1997 Yewer, Jr.
5,611,084 A 3/1997 Garry et al.
5,638,548 A 6/1997 Kawakami
5,699,559 A 12/1997 Sano
5,778,452 A * 7/1998 Dicker ..... A41D 13/0015 2/227
5,792,034 A 8/1998 Kozlovsky
5,799,328 A 9/1998 Harlem et al.
5,822,794 A * 10/1998 Allred ..... 2/115
5,823,851 A 10/1998 Dicker
5,829,058 A 11/1998 Dicker et al.
5,842,959 A 12/1998 Wilkinson
5,857,947 A 1/1999 Dicker et al.
5,867,827 A 2/1999 Wilkinson
5,896,578 A 4/1999 Hunter et al.
5,937,442 A 8/1999 Yamaguchi et al.
5,948,707 A * 9/1999 Crawley et al. ..... 442/101
5,960,474 A 10/1999 Dicker et al.
5,978,965 A 11/1999 Summers
5,978,966 A 11/1999 Dicker et al.
5,996,120 A 12/1999 Balit
6,006,363 A 12/1999 Karlin
6,061,832 A 5/2000 Morrison, Jr.
6,068,606 A 5/2000 Castel et al.
6,080,038 A 6/2000 Sano
6,086,551 A 7/2000 Allen
6,138,281 A * 10/2000 Chiaruttini ..... 2/239
6,146,240 A 11/2000 Morris
6,176,816 B1 1/2001 Dicker et al.
6,195,801 B1 3/2001 Meyers
6,231,488 B1 5/2001 Dicker et al.
6,240,564 B1 6/2001 Te Kanawa
6,260,201 B1 7/2001 Rankin
6,279,164 B1 8/2001 Martin
6,287,242 B1 9/2001 Fray
6,314,580 B1 11/2001 Greenberg et al.
6,364,851 B1 4/2002 Nafpliotis
6,375,581 B1 4/2002 Urban et al.
6,430,753 B2 8/2002 Duran
6,454,628 B1 9/2002 Shunichirou
6,546,560 B2 4/2003 Fusco et al.
6,620,026 B1 9/2003 Guilani et al.
6,684,410 B2 2/2004 Robinett et al.
6,698,026 B2 3/2004 Schweer
6,708,342 B2 * 3/2004 Boersema ..... 2/69
6,719,712 B2 4/2004 Zigmont
6,766,536 B1 * 7/2004 Aarons ..... 2/161.3
6,805,681 B2 10/2004 Yokoyama
6,892,396 B2 5/2005 Uno et al.
7,074,204 B2 7/2006 Fujii et al.
7,087,032 B1 8/2006 Ikeda
7,089,597 B2 8/2006 Horii et al.
7,117,537 B2 * 10/2006 Mazzarolo ..... 2/69
7,117,538 B2 10/2006 Bosne et al.
7,191,470 B2 3/2007 Benini
D539,512 S 4/2007 Ota et al.
7,241,252 B1 7/2007 Gagliardi
7,246,381 B2 7/2007 Green
7,374,523 B2 5/2008 Weir et al.
7,395,557 B1 7/2008 Ledyard
7,500,274 B1 * 3/2009 Kallen ..... 2/227
7,559,093 B2 7/2009 Sudo et al.
7,568,966 B2 8/2009 Abbey et al.
7,625,625 B2 * 12/2009 Rios et al. ..... 428/141
7,631,367 B2 12/2009 Caillibotte et al.
7,636,950 B2 * 12/2009 Melhart et al. ..... 2/69
7,730,553 B2 6/2010 Benini
7,748,056 B2 * 7/2010 Mickle ..... 2/115
7,908,670 B2 3/2011 Semba et al.
7,934,267 B2 5/2011 Nordstrom et al.
7,996,924 B2 8/2011 Wright et al.
8,087,096 B2 * 1/2012 Klein et al. ..... 2/161.6
8,123,663 B2 2/2012 Fey et al.
8,156,572 B2 4/2012 Whaley
8,225,423 B2 7/2012 Benini
8,281,414 B2 * 10/2012 Mickle ..... 2/115
8,397,315 B2 * 3/2013 Blakely et al. ..... 2/461
2002/0078485 A1 6/2002 Ferreiro
2003/0028952 A1 2/2003 Fujii et al.
2003/0233062 A1 12/2003 McCormick et al.
2004/0000002 A1 1/2004 Hollander
2004/0016041 A1 1/2004 Uno et al.
2004/0107479 A1 6/2004 Dicker et al.
2004/0111782 A1 6/2004 Lenormand et al.
2004/0133959 A1 7/2004 Horii et al.
2004/0255358 A1 12/2004 Ota et al.
2005/0038367 A1 2/2005 McCormick et al.
2005/0081277 A1 * 4/2005 Matechen et al. ..... 2/102
2005/0086721 A1 4/2005 Lambertz
2005/0193461 A1 9/2005 Caillibotte et al.
2005/0197607 A1 9/2005 Brown
2006/0026732 A1 2/2006 Nordt et al.
2006/0026733 A1 2/2006 Nordt, III et al.
2006/0026740 A1 2/2006 Vargas et al.
2006/0070164 A1 4/2006 Nordt, III et al.
2006/0070165 A1 4/2006 Nordt, III et al.
2006/0101553 A1 5/2006 Aspray
2006/0129076 A1 6/2006 Haneda
2006/0169004 A1 8/2006 Belluye et al.
2006/0200890 A1 * 9/2006 Prat Gonzalez ..... 2/69
2007/0000006 A1 * 1/2007 Jordan et al. ..... 2/51
2007/0000014 A1 * 1/2007 Rotella et al. ..... 2/114
2007/0050879 A1 3/2007 Etzold et al.
2007/0271668 A1 11/2007 Pape
2007/0271671 A1 11/2007 Okajima
2007/0294801 A1 12/2007 Furgerson et al.
2008/0022431 A1 1/2008 Gallo et al.
2008/0066211 A1 3/2008 Laugt et al.
2008/0076645 A1 3/2008 Brown
2008/0120757 A1 * 5/2008 Nakazawa ..... 2/22
2008/0134409 A1 6/2008 Karasina
2008/0141430 A1 6/2008 Rance et al.
2008/0141431 A1 6/2008 Rance et al.
2008/0178365 A1 7/2008 Furgerson et al.
2008/0189824 A1 8/2008 Rock et al.
2008/0256691 A1 * 10/2008 White et al. ..... 2/455
2008/0295216 A1 12/2008 Nordstrom et al.
2008/0319365 A1 12/2008 Kendrick
2009/0025115 A1 1/2009 Duffy et al.
2009/0062704 A1 3/2009 Brown et al.
2009/0133181 A1 5/2009 Nordstrom et al.
2009/0171259 A1 7/2009 Soerensen et al.
2009/0172858 A1 7/2009 Oya et al.
2009/0265828 A1 10/2009 Semba et al.
2010/0000005 A1 * 1/2010 Dossman ..... 2/122
2010/0050313 A1 3/2010 Shackelford, Jr.
2010/0077527 A1 * 4/2010 Lee et al. ..... 2/69
2010/0122403 A1 * 5/2010 Mickle ..... 2/461
2010/0186148 A1 * 7/2010 Crockett ..... 2/227
2010/0199406 A1 * 8/2010 Dua et al. ..... 2/115
2010/0229278 A1 * 9/2010 Bates ..... 2/115

* cited by examiner

YOGA ARTICLE OF CLOTHING AND METHOD OF USE THEREOF

FIELD OF THE INVENTION

The invention relates to functional yoga apparel.

BACKGROUND OF THE INVENTION

It is commonly known to use clothing such as gloves to aid humans in gripping objects, such as sports gloves worn by athletes for more secure grips on catching and throwing footballs, holding bats, holding golf clubs. Also certain rubber grips are helpful in improving grip and friction in wet conditions. These grip garment gloves are used by a wide variety of professions and disciplines to provide grip to the hand grasp of objects and to also sometimes protect from cold elements and even furthermore can protect from injury if the garment or cloth is thick enough or padded.

In some cases, reinforced cycling clothing may have patches of material with a different coefficient of friction than the remainder of the garment, for example on the seating portion.

In Yoga, a practitioner assumes various poses, which often result in contact between a limb and another body part. Holding a pose may require balance and strength. Further, the poses may require strength, and result in perspiration. Likewise, clothing worn during yoga may be slick and non-abrasive. Therefore, a problem arises that the frictional coefficient between the limb and another body region that is sought for contact is insufficient to maintain a pose without exerting forces, and indeed, the positions may be such that no normal muscle group is available to exert such forces. Therefore, the pose may fail or be unduly difficult, for reasons distinct from the "purpose" of the pose.

Cloth used for Yoga exercise typically has a lower coefficient of friction than that of typical skin, and thus sliding is likely. Traction enhanced gloves, socks or footwear are known for use in Yoga exercises. These gloves and socks have even been incorporated in the Yoga community in the style of a grip glove or socks with rubber bumps on its palms or sole molded into the cloth. These Yoga marketed grip gloves and socks help with grip on the hands and feet, but don't generally cover the normal Yoga contact points, for example, on the legs and outside (posterior) of the arms.

A Yoga participant will generally want to get the best work out and achieve and maintain as good of form as possible while performing "Yoga moves" throughout the workout. Certain moves are more difficult than others and encounter situations where the performers of the moves finds themselves slipping off the fabric/garment of the clothing they are wearing, or off their own sweaty skin produced during excursion. Some of these moves are for stretching and balance and the effectiveness of the exercise is compromised or not achieved due to this slipping, and therefore the practitioner suffers excess slipping seeking to maintain the "Yoga move" and eliminating portions of the benefit of the move he or she is trying to perform.

See, e.g., U.S. Pat. Nos. 2,302,368; 2,831,196; 2,948,899; 2,986,740; 3,338,776; 3,526,229; 3,823,712; 4,273,216; 4,698,847; 4,730,625; 4,731,882; 4,862,523; 4,910,802; 4,911,439; 4,945,571; 4,946,453; 4,953,856; 4,993,705; 5,007,412; 5,014,358; 5,046,194; 5,088,728; 5,149,099; 5,179,942; 5,201,074; 5,282,277; 5,306,222; 5,337,418; 5,351,340; 5,367,708; 5,402,742; 5,410,755; 5,445,601; 5,451,060; 5,518,481; 5,536,246; 5,537,690; 5,542,123; 5,570,472; 5,582,583; 5,591,122; 5,611,084; 5,638,548; 5,699,559; 5,792,034; 5,799,328; 5,823,851; 5,829,058; 5,842,959; 5,857,947; 5,867,827; 5,896,578; 5,937,442; 5,960,474; 5,978,965; 5,978,966; 5,996,120; 6,006,363; 6,061,832; 6,068,606; 6,080,038; 6,086,551; 6,146,240; 6,176,816; 6,195,801; 6,231,488; 6,240,564; 6,260,201; 6,279,164; 6,287,242; 6,314,580; 6,364,851; 6,375,581; 6,430,753; 6,454,628; 6,546,560; 6,620,026; 6,684,410; 6,698,026; 6,719,712; 6,805,681; 6,892,396; 7,074,204; 7,087,032; 7,089,597; 7,117,538; 7,191,470; 7,241,252; 7,246,381; 7,374,523; 7,395,557; 7,559,093; 7,568,966; 7,631,367; 7,730,553; 7,908,670; 7,934,267; 7,996,924; 8,123,663; 8,156,572; 8,225,423; D539512; 20020078485; 20030028952; 20030233062; 20040000002; 20040016041; 20040107479; 20040111782; 20040133959; 20040255358; 20050038367; 20050086721; 20050193461; 20050197607; 20060026732; 20060026733; 20060026740; 20060070164; 20060070165; 20060101553; 20060129076; 20060169004; 20070050879; 20070271668; 20070271671; 20070294801; 20080022431; 20080066211; 20080076645; 20080120757; 20080134409; 20080141430; 20080141431; 20080178365; 20080189824; 20080295216; 20080319365; 20090025115; 20090062704; 20090133181; 20090171259; 20090172858; 20090265828; 20100050313; 20100077527; each of which is expressly incorporated herein by reference in its entirety.

SUMMARY OF THE INVENTION

The present invention therefore provides a garment or apparel which is specially designed to provide regions of high static friction located where body contact is desired. Preferably, regions outside of the preferred contact region are devoid of the frictional material, for example to facilitate entering into the pose and to avoid interference with other activities.

Because the regions of contact are also regions of wear, preferably, the frictional material has a high durability, and may be, for example, more durable than the remaining material. Similarly to frictional characteristics, the durability typically comes at a cost of decreased flexibility and breathability, and therefore may be restricted to wear regions of the garment. Likewise, the added grip portions may add to cost, and therefore limiting the amount of grip material may help ensure acceptable garment cost. Outside of the grip regions, the garment is preferably elastic and skin-hugging.

The grip regions may be formed of a material having a high coefficient of friction with respect to (a) dry skin and hair; (b) moist skin; (c) normal portions of the garment; (d) other grip regions on the garment; and (e) a floor or mat. On the other hand, the non-grip regions of the same garment preferably glide against wet and dry skin, and hair, and other non-grip portions of the garment. In addition, the grip portions may be textured, such as with a pattern of bumps or protrusions, or a geometric pattern, to engage opposing surfaces and to provide edges for "bite". The texture is preferably such that the grip portions do not catch on or abrade non-grip portions. In a preferred embodiment, a combination of texturing and material is employed to generate the required characteristics.

Preferred materials for the grip portions are neoprene rubber, polyurethane, PVC coated woven polyester, polyester substrate or silicone rubber, though latex and other elastomers may be employed.

The grip portions may be formed on the garment by sewing patches onto the garment, applying patches with an adhesive, molding an elastomer (e.g., thermoset) onto the surface of the garment, melting a thermoplastic resin (e.g., ultrasonic bonding) patch onto the garment, or the like.

In some cases, the grip portions are provided intrinsically to the garment, for example as a result of selectively weaving a tacky elastomer fiber at appropriate locations on the garment, while using less sticky (e.g., Spandex®) fibers for a remainder of the garment. Spandex®, also known as elastane, is a fabric formed of polyester-polyurethane copolymer.

When non slip grip material, such as a natural or synthetic rubber, is attached to Spandex and other stretchy material, it is preferably attached to the material as separated sections spaced apart, to compensate for the yield the material will give when the wearer puts the clothing piece on (e.g. when a wearer wears spandex biker shorts, the spandex shorts stretch to conform around the wearers body) or stretches during exercise use. Therefore, especially in body regions subject to such stretch, the grip is interrupted. On the other hand, over body regions where stretch of the material during dressing and exercise is not high, in some cases it is preferred to have expanses of grip material, which may also provide padding.

According to one embodiment, the patches of grip material are sewn to an elastic fabric. All attached pieces of non slip grip strips are preferably stitched in such a manner that the stitch straddles all the edge of the non slip rubber grip strip/section, to prevent any catching or pulling on the edge, and to reduce accelerated wear and fatigue of the material and stitch point or seam. If the grip material is attached by heat bonding or adhesive, the grip material is preferably bonded to the underlying material all the way to the edges, for example by overlapping an adhesive on all edges in excess, and smoothed so as to leave no catching/pulling edges.

Therefore it is useful to have clothing or garments that would aid and assist Yoga participants in performing Yoga poses, stretches, moves and holds (balance, static and dynamic). The clothing would achieve this by providing friction and resistance to the relative motion/sliding of the body part at the various contact points on the body of the Yoga performer, yet provide smooth surfaces away from these contact points and a flexible, stretchable, and breathable fabric for the bulk of the garment.

The garment may be, for example, pants, Capri pants, shorts, a long sleeve shirt, a short sleeve shirt, arm sleeves (thermo), arm bands (sweat bands), and knee/elbow braces.

In one embodiment, the article has a non-slip rubber heel grip with a nylon stretching strap with loops, wherein the non-slip rubber Heel/foot loop with narrow nylon straps for stretching attach to the inside (between skin and fabric) medial and lateral surfaces of the pant seams of the article. Further, the nylon straps may have loops along the length that protrude through the article (pant legs) to be exposed on the outside of the article.

According to one embodiment, stretching straps are integrated, which provide a wearer with grasp or retention points by way of, for example, thin nylon straps sewn into reinforced portions of the medial and lateral lining of the pants, with the nylon loops protruding through the pants at locations along the medial and lateral seam/lining between the ankle and knee. The reinforcement is preferably circumferential around the limb. This nylon strap reinforcement may be continuous and connected to a heel loop or stirrup at the bottom of the pants leg, in the ankle hem/seam. This heel loop may be a frictional material to provide slip resistance to the wearer, and also act as an anchor when pulling on the nylon straps for deep leg stretches.

A similar structure may be provided by providing ankle or shin stretching straps, which are integrated into a lining of the pants. Medial and lateral loop straps may be affixed to a band structure tightened around the leg with, for example, a Velcro closure on a neoprene strap. The strap may be padded, for example with a nylon-neoprene/closed cell foam ankle and shin support. The support and securing straps may connect to the medial and lateral nylon loop straps at a 90 angle, to surround the ankle and upper calf while distributing the forces. The medial and lateral loop straps preferably continue to connect to a rubber heel loop for anchoring.

Another embodiment provides yoga footwear having a footwear upper and sole, which are integral with an ankle and calf surround. Similar to the aforementioned ankle structure, a set of bands are provided surrounding the lower calf, with pull loops extending from the medial and/or lateral sides, supported at the bottom by a band which loops under the arch, and at the top by a tightened strap. In this case, a footwear structure is integrated, and therefore a further grasping element may be provided at the toe, which has an inelastic connection to the ankle retention structures. The footwear aspect may resemble a sock, which has rubberized or grip applied portions on the bottom.

In another embodiment, the non-slip frictional grips areas/patterns can be in the most basic form of simply geometric shape strip sections, or can be arbitrarily shaped stamped patterns, such as characters, Chinese lettering/characters, pictures, logos, etc.

Moves, Poses and Stretches that may be facilitated according to the present technology include, but are not limited to:

Poses

1. Reverse warrior Pose (hamstring and calf grips)
2. Triangle Pose (lateral thigh grip, lateral arm grip)
3. Twisting chair Pose (lateral thigh grip, lateral arm grip)
4. Prayer Twist Pose (lateral thigh grip, lateral arm grip)
5. Right Angle Pose (lateral thigh grip, lateral arm grip)
6. Extended Right Angle Pose (lateral thigh grip, lateral arm grip)
7. Right Angle Pose & Grab Pose (lateral thigh grip, lateral arm grip)
8. Prayer Twist from Runner's Pose (lateral thigh grip, lateral arm grip)
9. Sidearm Balance (for ankles grips and inner thigh/knee grips)
10. Meditation Pose (Inner thigh grip, lateral arm grip)

Balances Poses

1. Tree Pose (Inner thigh/knee grip)
2. Royal Dancer (ankle grip, ankle nylon stretch loop)
3. Crane Pose (Inner thigh/knee grip, lateral arm grip)

Stretches

1. Flat Back Stretch (shin grip)
2. Seated Spinal Stretch (lateral thigh grip, lateral arm grip)
3. Frog Stretch (Inner thigh/knee grip, lateral arm grip)
4. Plough into Shoulder Stand Pose (Shirt with grip on lower and mid back)
5. Shoulder Stand Pose (Shirt with grip on lower and mid back)
6. Cobbler Pose/Stretch (Inner thigh/knee grip, lateral arm grip)
7. Side Twist Stretch
8. Hamstring Stretch (Nylon Loops)
9. Glute Stretch
10. Happy Baby Stretch The above and below advantages and features are of representative embodiments only, and are not exhaustive and/or exclusive. They are presented only to assist in understanding the invention. It should be understood that they are not representative of all the inventions defined by the claims, to be considered limitations on the invention as defined by the claims, or limitations on equivalents to the claims. For instance, some of these advantages may be mutually contradictory, in that they cannot be simultaneously present in a single embodiment. Similarly, some advantages are applicable to one aspect of the invention, and inapplicable to others. Furthermore, certain aspects of the claimed invention have not been discussed herein. However, no inference should be drawn regarding those discussed herein relative to those not discussed herein other than for purposes of space and reducing repetition. Thus, this summary of features and advantages should not be considered dispositive in determining equivalence. Additional features and advantages of the invention will become apparent in the following description, from the drawings, and from the claims.

BRIEF DESCRIPTION OF THE DRAWINGS

The features and advantages of a clothing article according to the present invention will be more clearly understood from the following description taken in conjunction with the accompanying drawings in which like reference letters designate similar or corresponding elements, regions and portions and in which.

DETAILED DESCRIPTION OF THE PREFERRED EMBODIMENTS

The Yoga apparel according to various aspects and embodiments of the invention allows a wearer to more easily hold poses, stretches and balance moves. A suite or ensemble of clothing also allows the wearer to push for deeper stretches or hold themselves (the wearer) back from over stretching. This suite has strategically placed non slip grip strips, to provide grip during certain and particular moves, poses and stretches. The suite uses, for example, rubber non-slip grip strips which may be sewn or adhered onto the clothes. The suite of clothing may include, for example, pants or shorts and shirts of various possible sleeve lengths. Thermal arm and/or leg sleeves may also be used instead of full clothing.

A pants embodiment provides non-slip grips strategically placed in various locations. These locations typically include the inner (medial) thigh/knee, outer thigh/knee (lateral), back (posterior) of the leg over the lower hamstring region. Below the knee the pants has strategically placed non slip rubber grip on the inner (medial) and outer (lateral) ankle and also non slip rubber grip placed on the back (posterior) of the ankle from the Achilles tendon to the calf region. Also non slip rubber grip placed over the shin (anterior) mid way between ankle and knee cap/patella.

Figure 1:
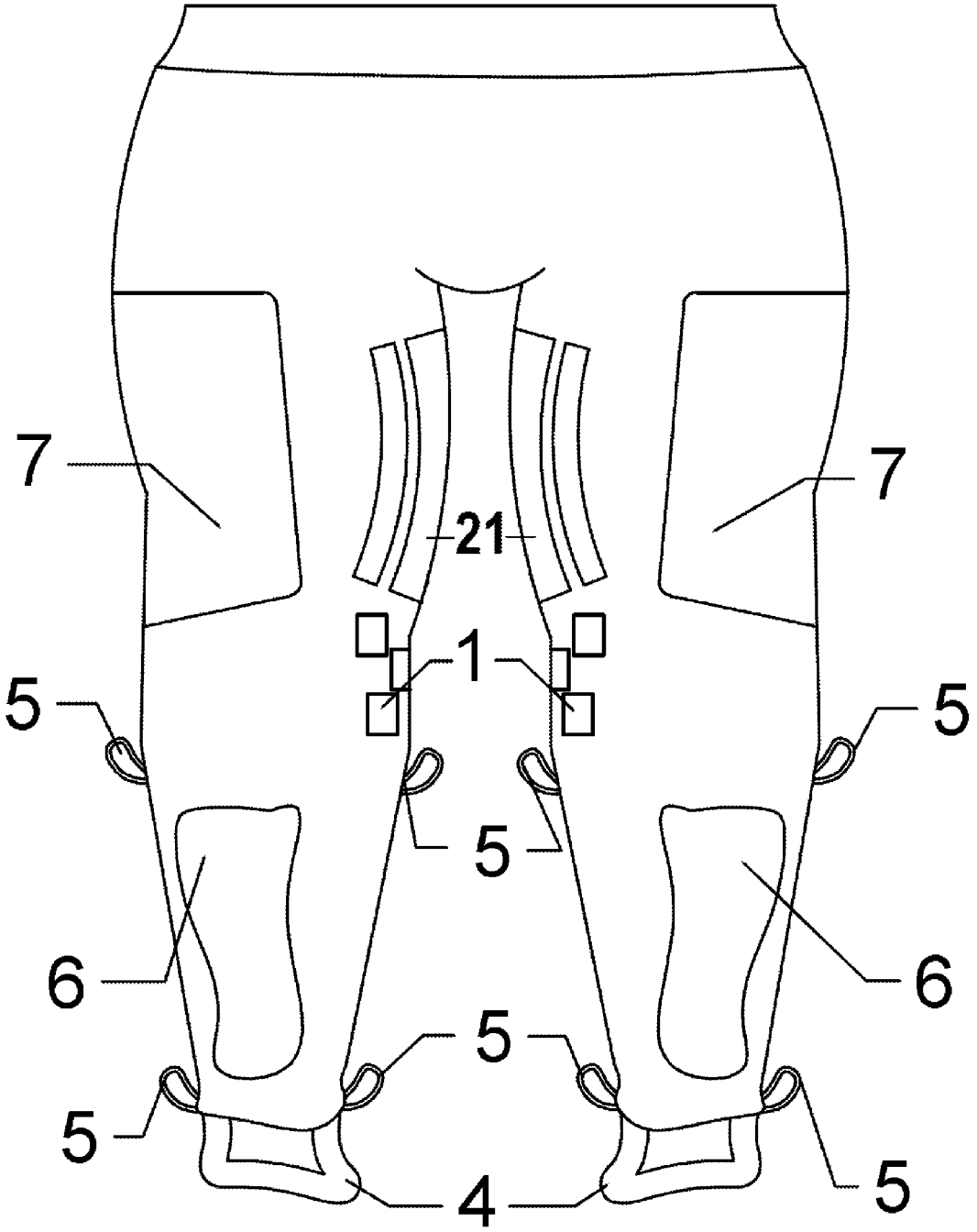
FIGS. 1, 2 and 3 show, respectively, a front, inner thigh and rear view of yoga pants and grip locations according to the present invention.
Figure 2:
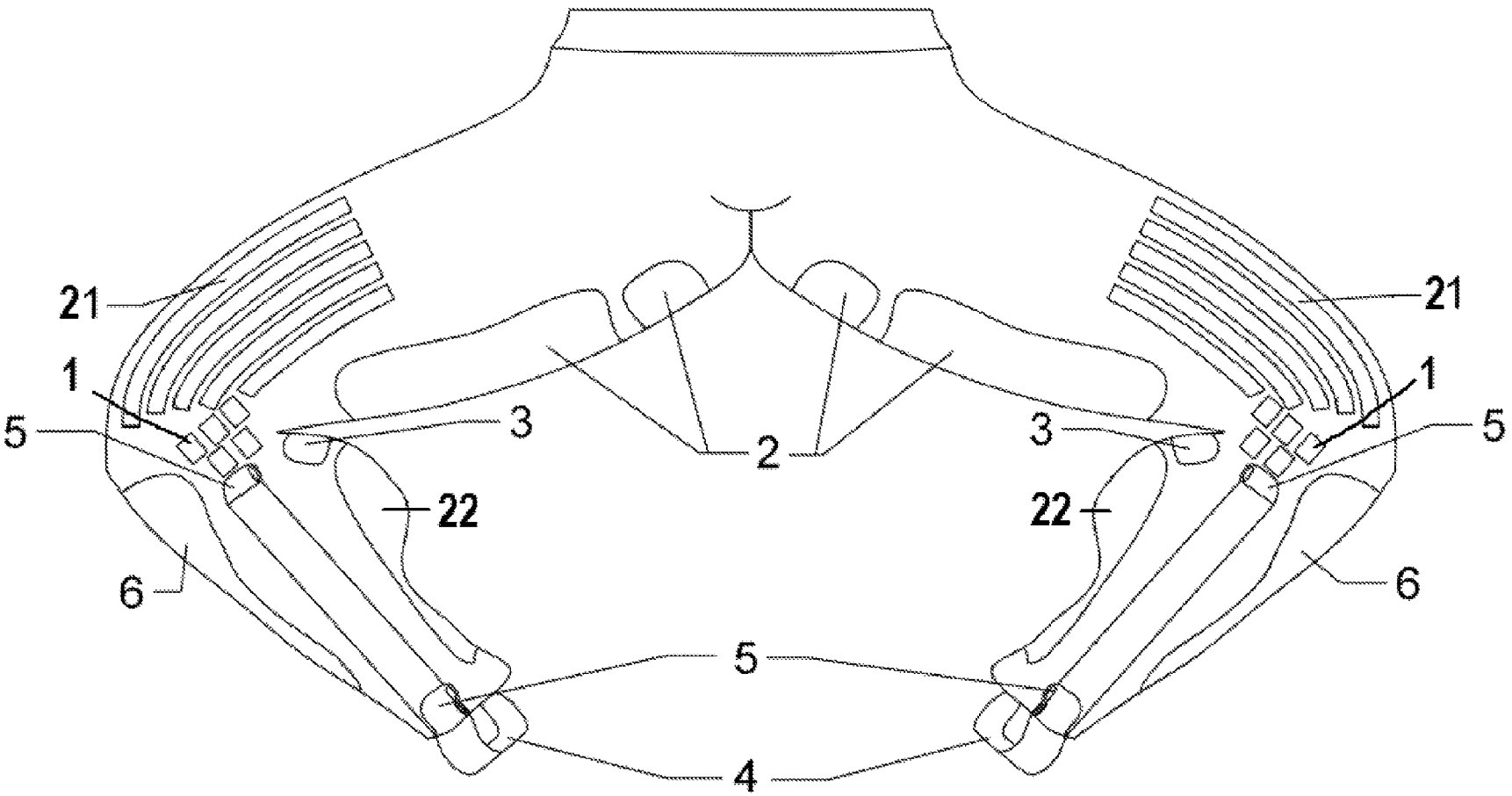
Figure 3:
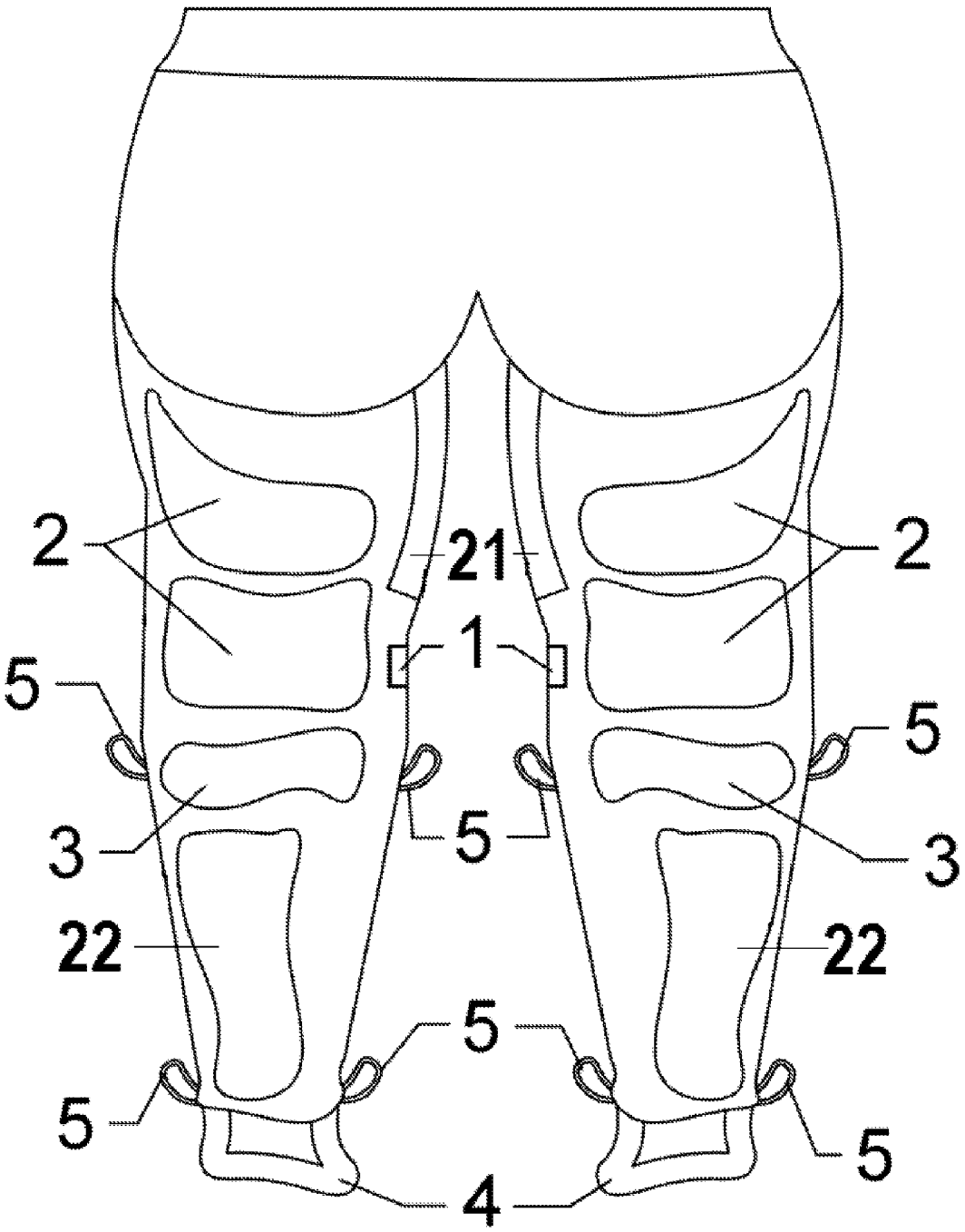

FIGS. 1-3 show yoga pants having selectively provided grip locations on the outer thigh 7, inner thigh 21, hamstring area 2, rear of knee 3, calf 22, medial aspect of knee 1, and shin 6, and further showing a strap system 5 with exterior loops protruding below the knee and above the ankle. An anchor 4 is provided surrounding the foot, which resists pulling on the strap system 5, and has a grip surface to provide traction.

A user wears the pants during exercise and stretching, for example during yoga exercises. The grip locations on the inner thigh 21 and medial aspect of the knee 1 assist the user in maintaining position for example in a tree pose, where the sole of the foot, including anchor 4, is in direct contact with the grips of the opposite thigh 21 and knee 1. The grips are provided with sufficient friction with respect to the anchor 4 and bare skin to permit the user to readily maintain the pose without slipping. Likewise, other grip locations assist the user in maintaining different poses which may be difficult.

A shorts embodiment is similar to the pants embodiment, but avoids structures below the knee. The shorts thus typically have non slip grips, which are a natural or synthetic rubber or other elastomer, strategically placed in locations. These locations are the inner (medial) thigh/knee, outer thigh/knee (lateral).

Figure 4:
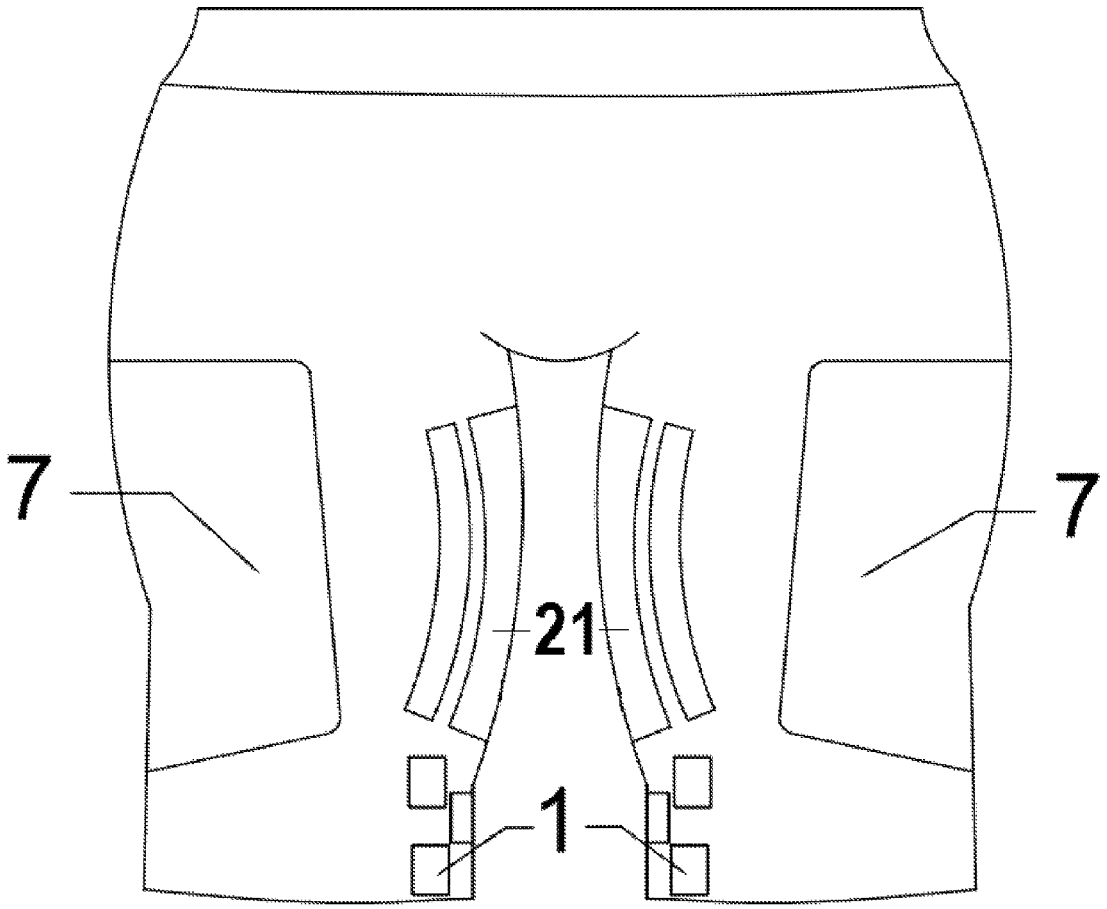
FIGS. 4 and 5 show, respectively, a front and rear view of shorts according to the present invention, with grip locations.
Figure 5:
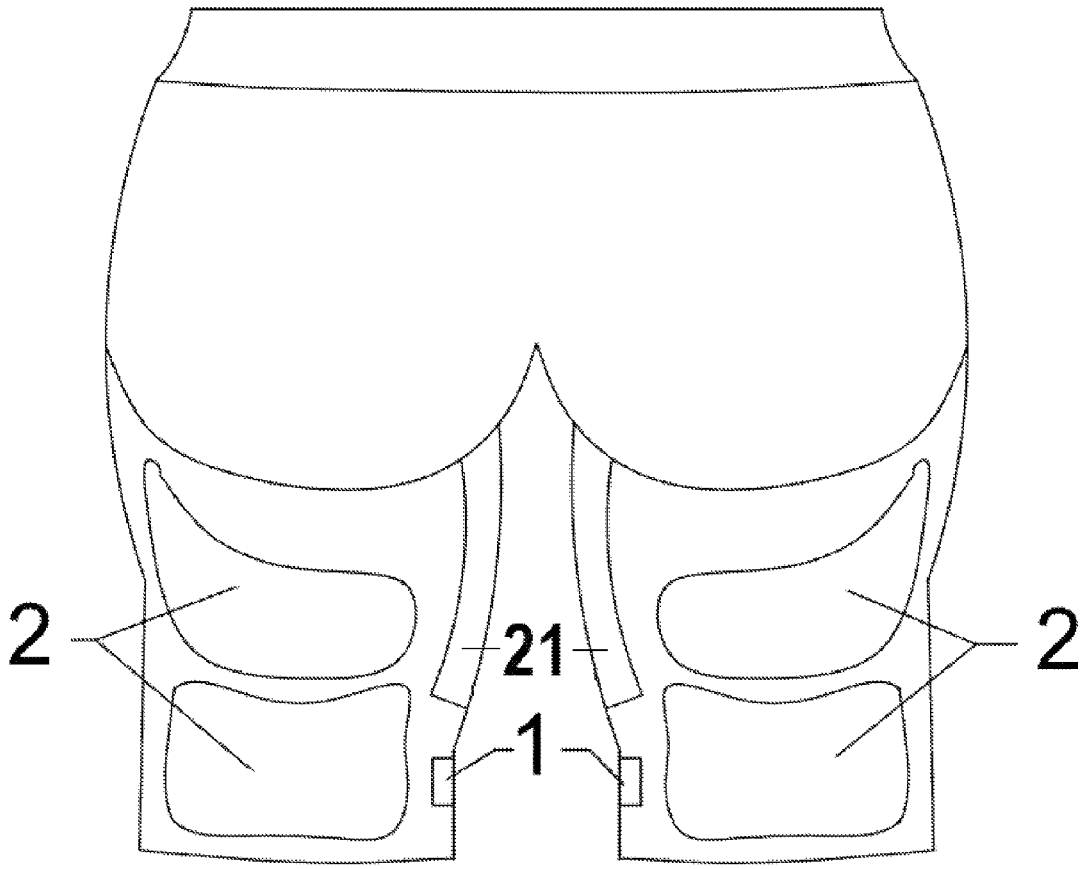

FIGS. 4-5 show the shorts having grip strips on the medial thigh region 21 and medial knee 1, as well as larger patches of grip material 7 over the anterior and lateral thigh. Similarly to the pants, strategically placed grip patches are provided on the rear of the thigh over the hamstring area 2. The grip patches may be unitary or separated, for example the hamstring patches 2 as shown in FIG. 5, which provide an enhanced ability of the garment to readily stretch in spite of the significant reinforcement from the patches. The grip strips on the medial thigh 21 and inner knee 1 also permit the underlying material to stretch, and further provide a set of edges which can further enhance the non-slip performance of the garment, for example, with respect to sweat-moistened skin.

In some body regions, for example the inner thigh 21 and medial knee 1, the skin can be sensitive, and therefore the overlying strips or patches may include a padding material or component. For example, the patches or strips may be formed of a foam rubber (open or closed cell) or gel material which distributes load and buffers shock. An air or fluid filled chamber may also be provided.

Figure 10:
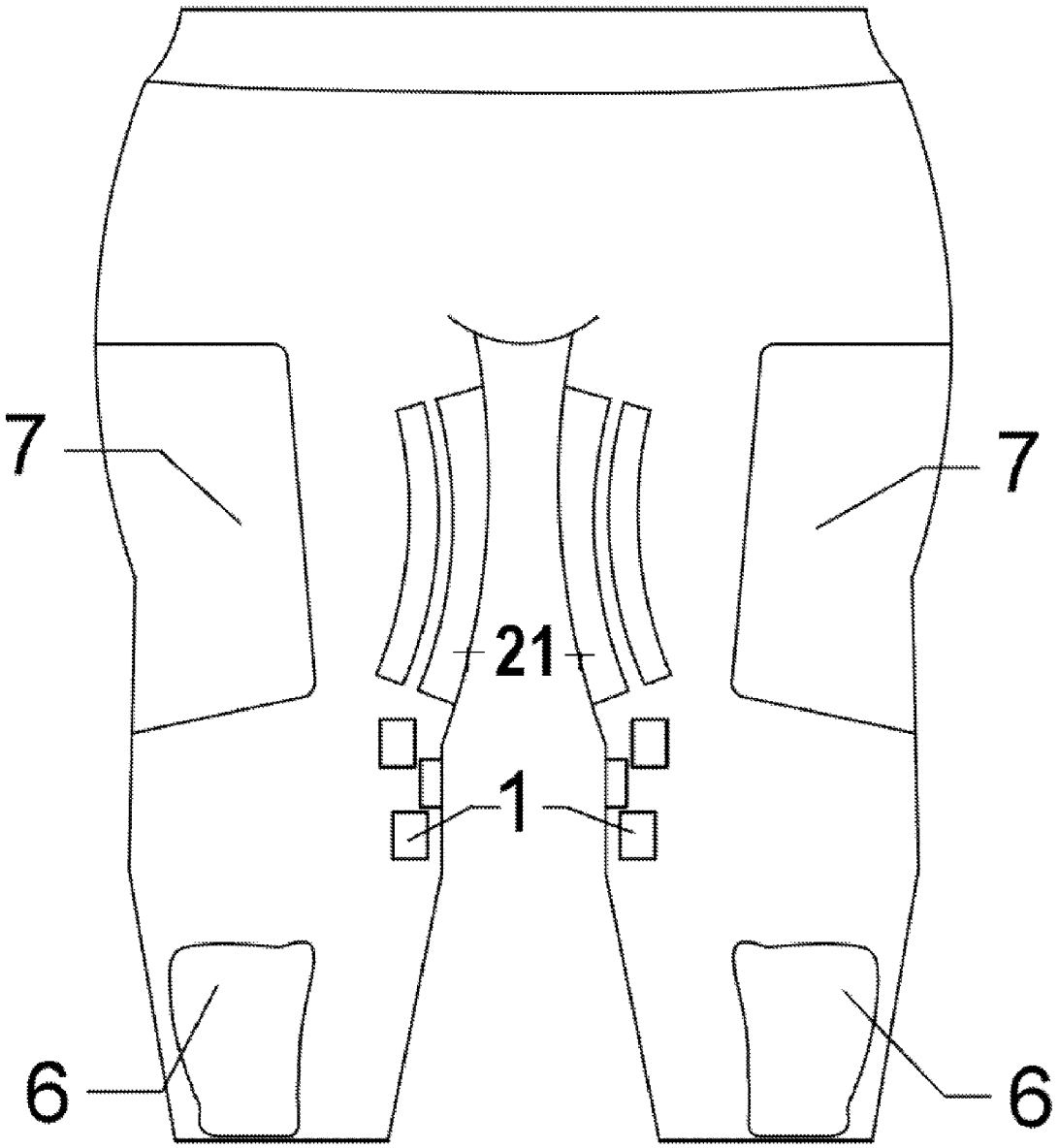
FIGS. 10 and 11 show, respectively, a front and rear view of Capri's according to the present invention with grip locations.
Figure 11:
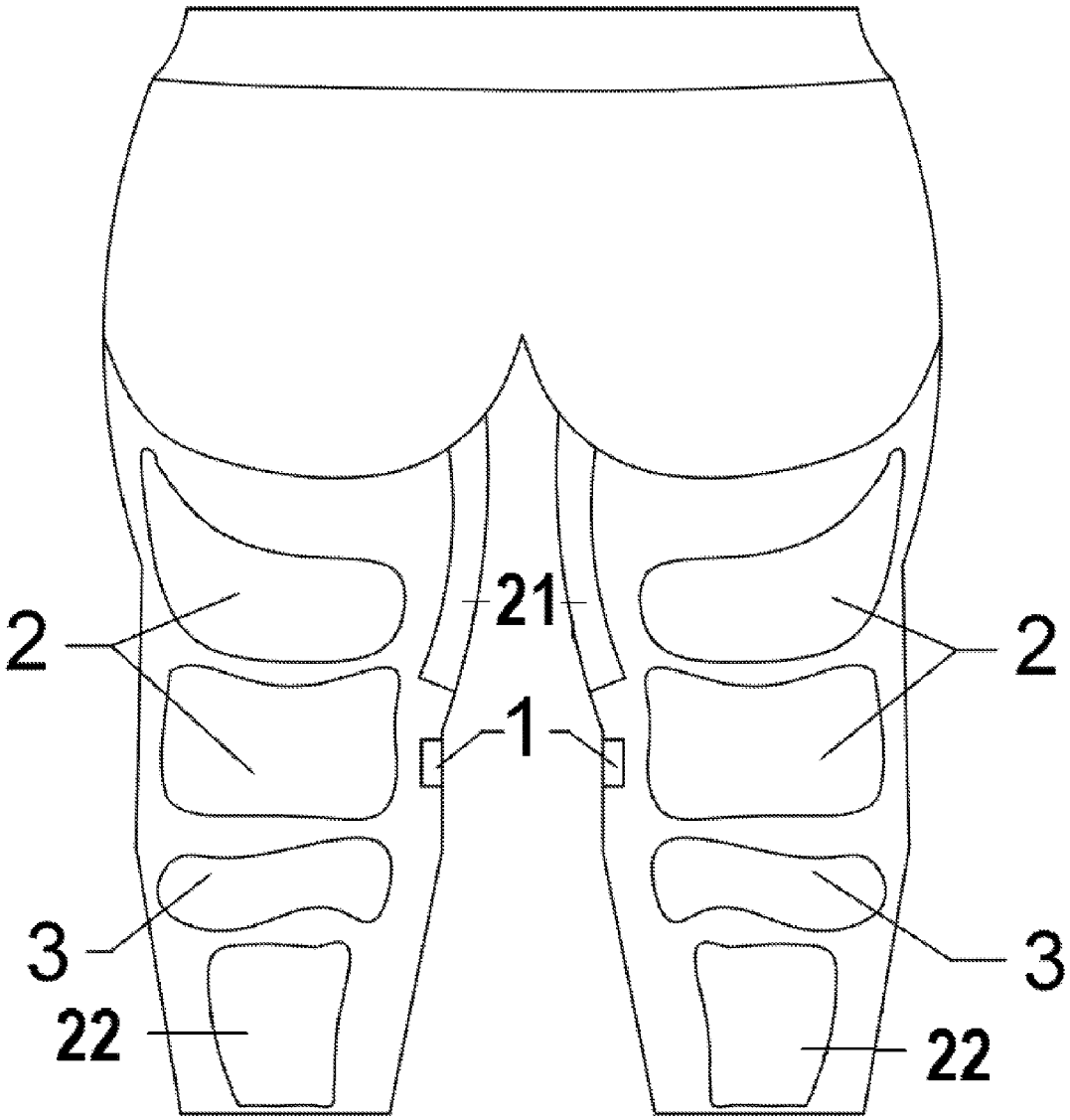

FIGS. 10-11 show a front view of a set of Capri's. Similar to the yoga pants of FIGS. 1-3, the capris have selectively provided grip locations on the outer thigh 7, inner thigh 21, hamstring area 2, rear of knee 3, calf 22, medial aspect of knee 1, and shin 6. The strap system 5 and anchor 4 shown in FIGS. 1-3 is not provided in this case.

Figure 6:
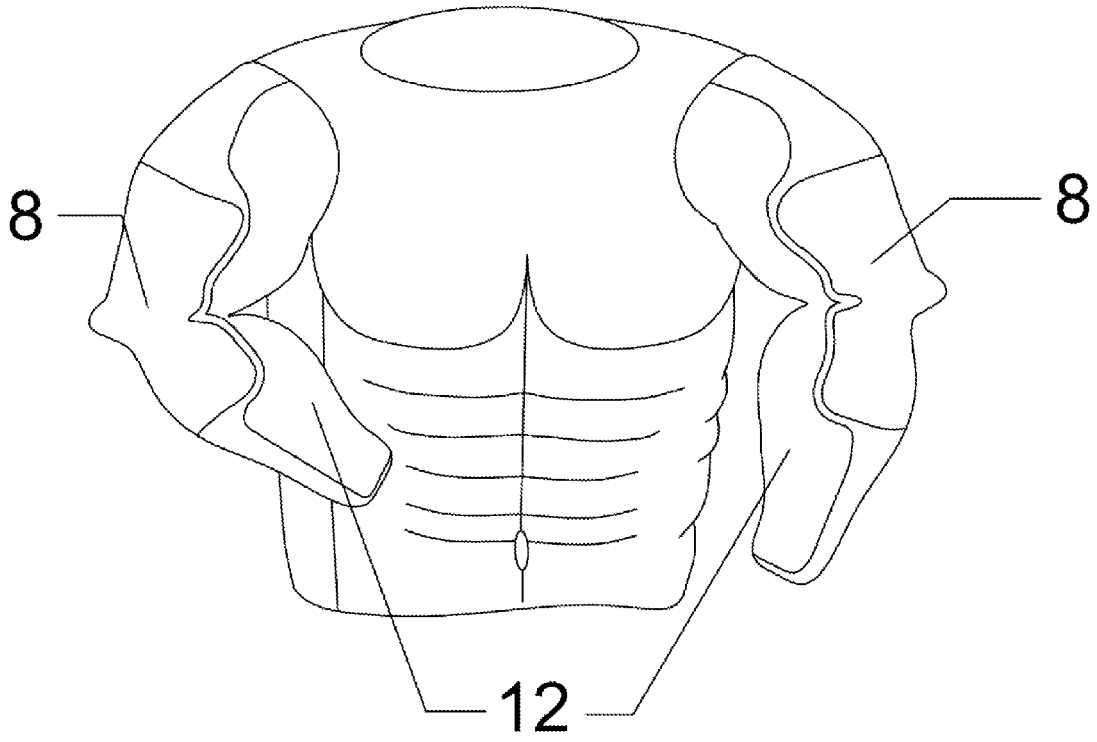
FIGS. 6 and 7 show, respectively, a front and rear view of a long sleeve shirt with grips, towel locations, and padded grip locations.
Figure 7:
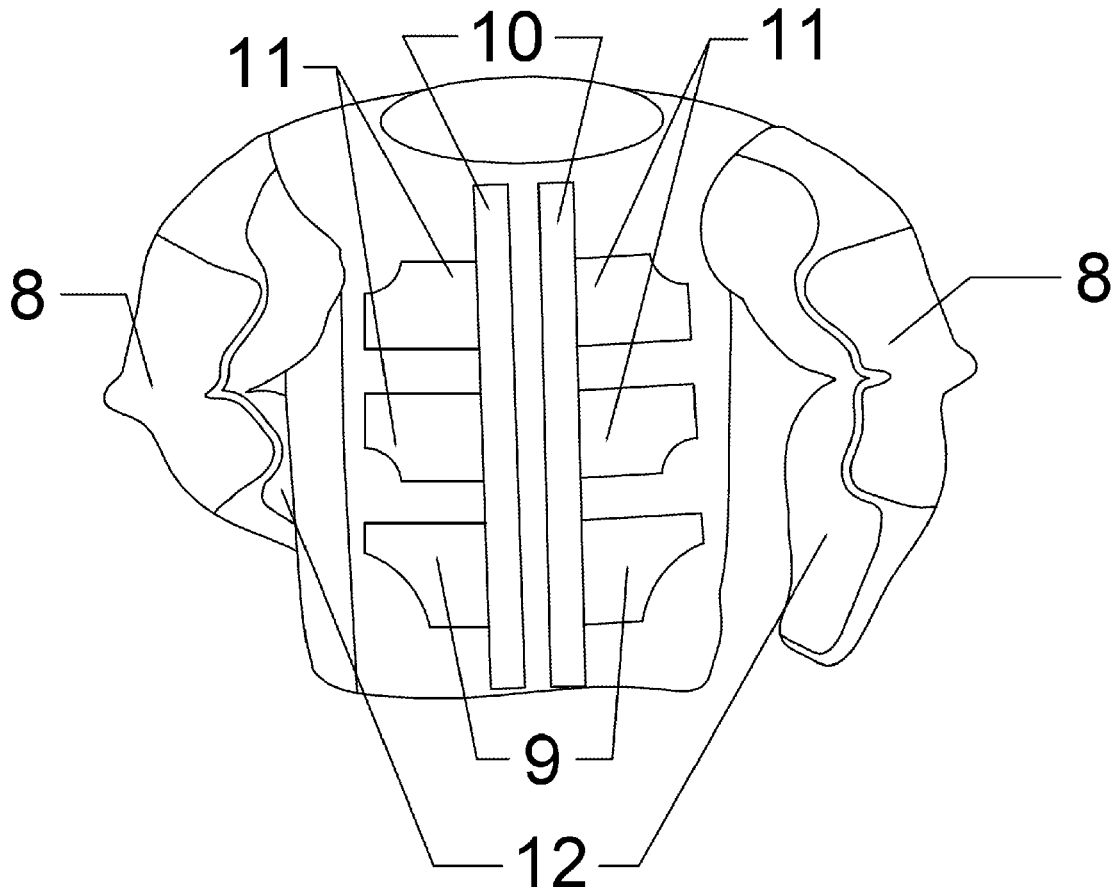

FIGS. 6 and 7 show a long sleeve shirt embodiment. The long sleeve shirt has strategically placed non-slip rubber grip on the sleeves 8 of the shirt. (Outer arm region, over the outer (Posterior) side of arm located over the Triceps, Brachii, Brachioradialis, Supinator, Extensor Carpi Ulnaris, Extensor Carpi Radialis Longus, Extensor Carpi Radialis Brevis, & Abductor Pollicis Longus muscle group area). The placement of the non-slip grip is preferably from the upper forearm over the elbow and terminating at the mid tricep region. As discussed above, the grip may be padded or essentially unpadded, and may be a single patch or be interrupted. The extents for the positioning of the non slip grip are, for example, from the posterior medial/lateral line of the arm wrapping around outwardly/posteriorly/laterally and terminating at the apex/point of the elbow.

According to one aspect of the invention, a moisture absorbent material 12, such as a napped cotton towel material, is provided on the inner aspect of the sleeve, for example from wrist to underarm and preferably over the deltoid, so that a wearer may wipe sweat from the face and head, or other locations. (Shoulder and entire inner/anterior arm region, over the outer Acromial/shoulder region down the axillary/armpit region following down the brachial/bicep region and continuing over the antecubital/front of elbow and antebrachial/forearm region and finally terminating at the carpal/wrist region.) The towel/absorptive material preferably covers the Deltoid (Anterior), Biceps Brachii, Triceps Brachii (Median), Extensors & Flexors of wrist and fingers Muscle Groups and terminating at the Retinaculum). This facilitates comfort, and permits the user to wipe sweat without reaching for a separate towel. However, it is noted that in the absence of an absorbent material, a wearer might still attempt to wipe sweat with the forearm, leading to wetness on the skin. This may lead to disadvantageous slipping under the garment.

The rear of the shirt may include a padded grip material 10, disposed for example parallel to the spine (median back along the back groove and spine column region, over the spinal vertebral bodies, tranverse spinous process and intra-spinal column muscle group areas, C 4-7, T 1-12, L 1-5, Sacrum). For both gripping and padding for rolling on the back. The shirt may also have non slip grip on the lower back 9 (both sides of the spine in the lower back and coccyx, lower Latissimus Dorsi, Sacrum-5 lumbar vertebrae spinal group area) and mid back 10 (Both sides of the spine in the mid and upper back region (over the bottom of the scapular, Upper Latissimus Dorsi, Lower Trapezius, Thoracic vertebrae 7-12) between the spinal column. These grips 9, 11 are optionally padded. The padded grips are bulky and may impair stretching, and thus may impair flexibility. However, some wearers may prefer padding to a degree in these locations.

Figure 8:
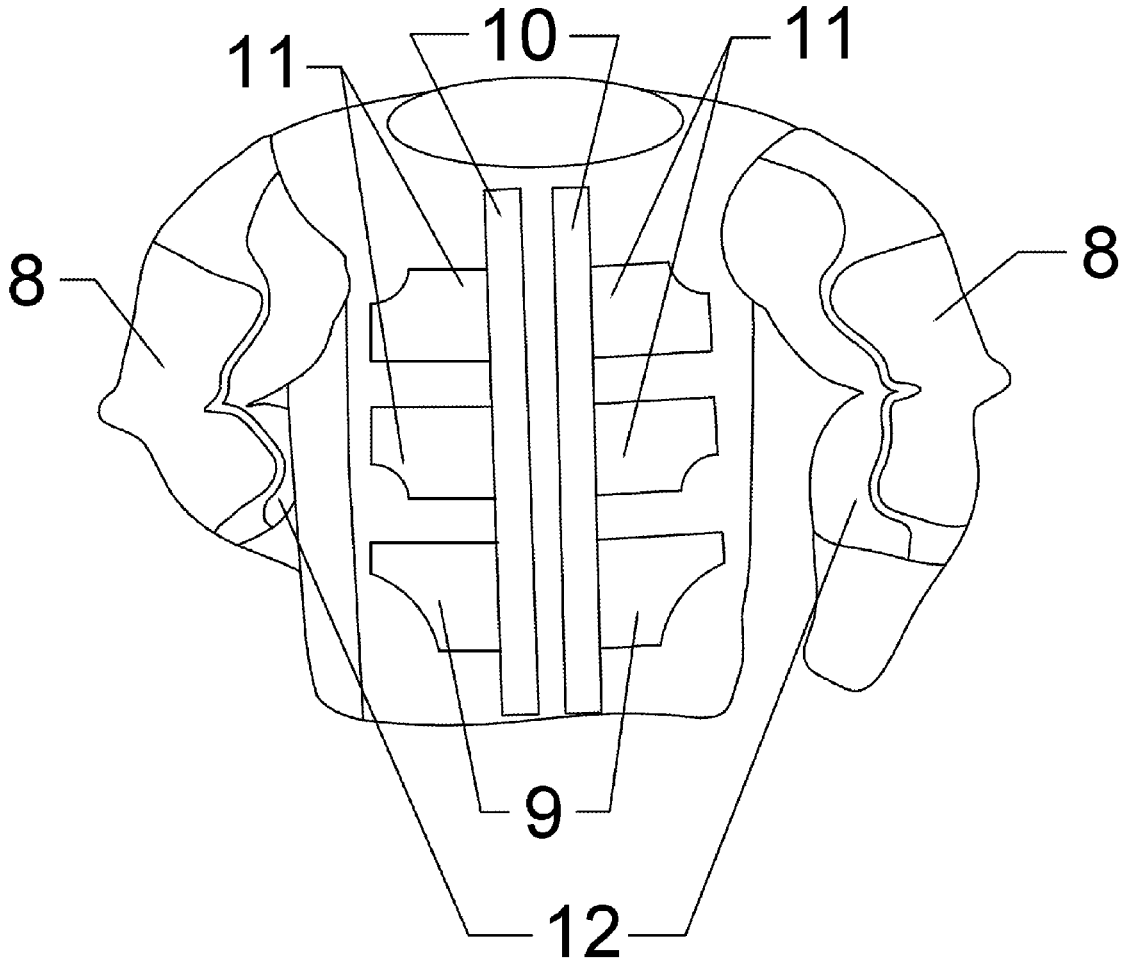
FIG. 8 shows a rear view of a three-quarter length sleeve shirt similar to FIG. 7, with grips, towel, and padded grip locations.

FIG. 8 shows a rear view of a three-quarter sleeve shirt, whose main difference from FIG. 7 is the length of the sleeve, and an elastic edge, which in this case is larger and is intended to hold its location on the forearm, while in a long sleeve shirt, the sleeve is maintained in position at the wrist, which is smaller than the forearm, and therefore may have a less elastic band to anchor the sleeve. The shirt has strategically placed non-slip rubber grip 8 on the sleeves of the shirt (outer arm region, over the outer (Posterior) side of arm located over the Triceps, Brachii, Brachioradialis, Supinator, Extensor Carpi Ulnaris, Extensor Carpi Radialis Longus, Extensor Carpi Radialis Brevis, & Abductor Pollicis Longus muscle group area). The grip may be padded or essentially unpadded, and may be a single patch or be interrupted. The extents for the positioning of the non slip grip are, for example, from the posterior medial/lateral line of the arm wrapping around outwardly/posteriorly/laterally and terminating at the apex/point of the elbow. A moisture absorbent material 12, such as a napped cotton towel material, is provided on the inner aspect of the sleeve (shoulder and entire inner/anterior arm region, over the outer acromial/shoulder region down the axillary/armpit region following down the brachial/bicep region and continuing over the antecubital/front of elbow and antebrachial/forearm region and finally terminating at the carpal/wrist region. The Towel/absorptive material covers over the Deltoid (Anterior), Biceps Brachii, Triceps Brachii (Median), Extensors & Flexors of wrist and fingers Muscle Groups and terminating at the Retinaculum), for example from mid forearm to underarm, so that a wearer may wipe sweat from the face and head, or other locations.

Figure 9:
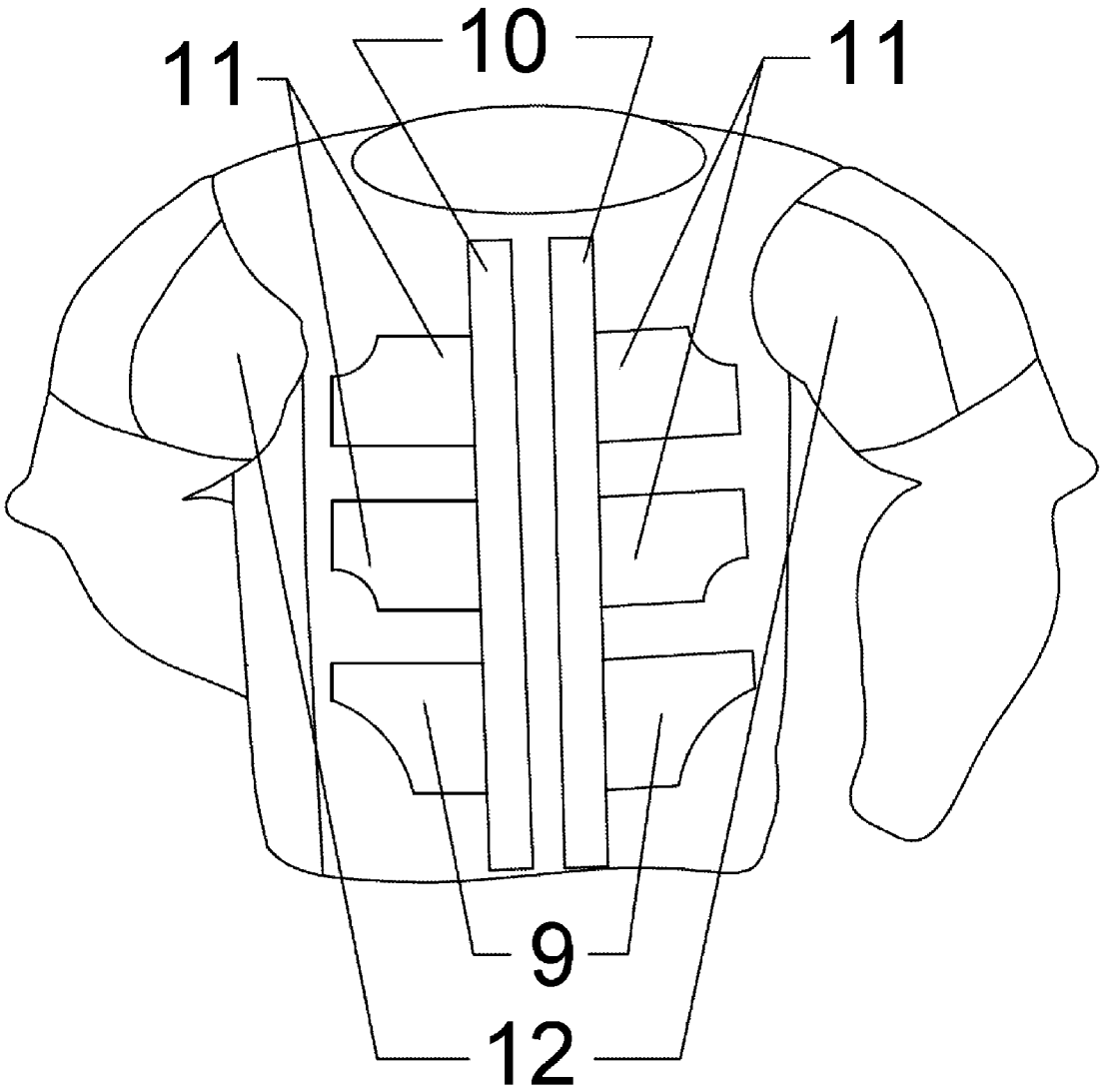
FIG. 9 shows a rear view of a short sleeve shirt similar to FIG. 7, with grip, towel and padded grip locations.
Figure 13:
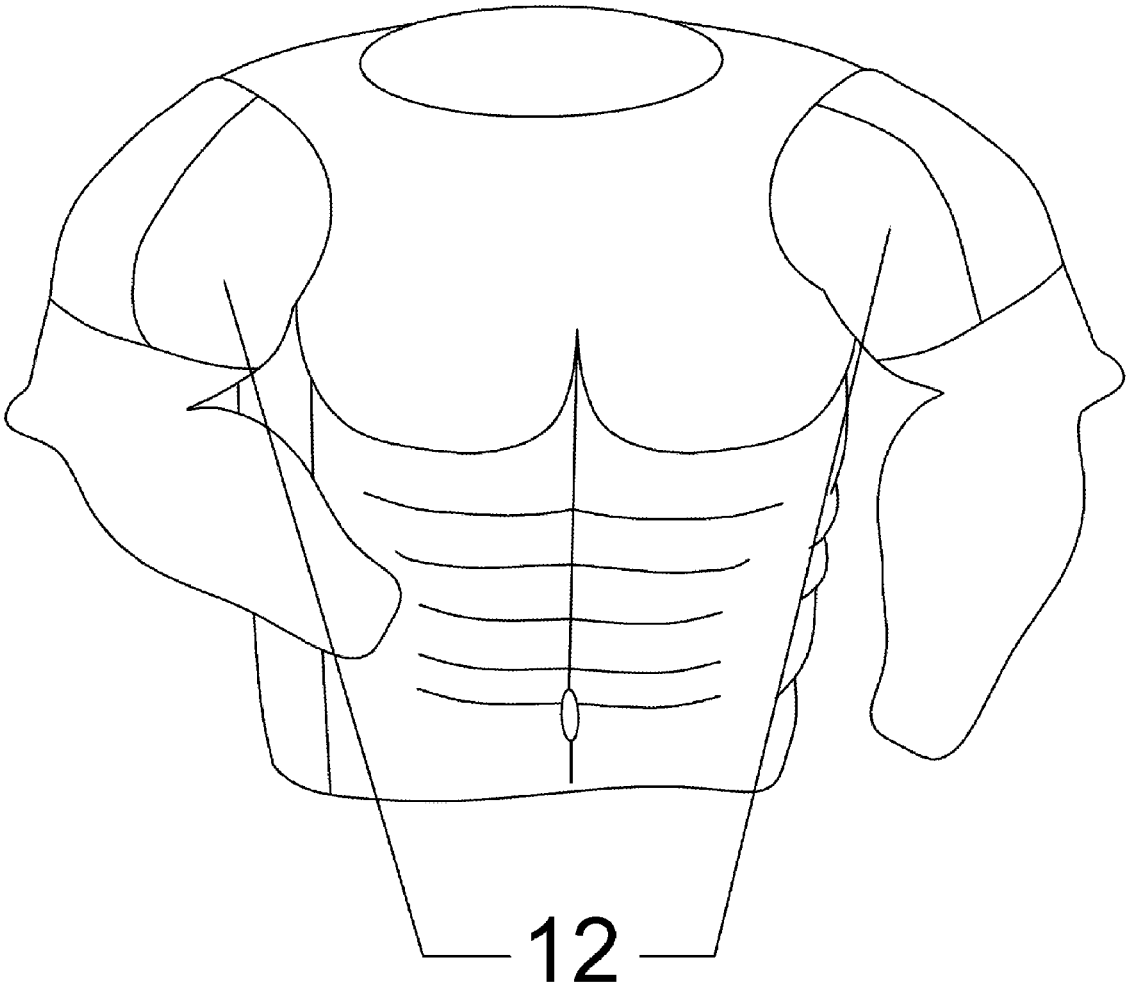
FIG. 13 shows a front view of the short sleeve shirt according to FIG. 9 with towel locations.

FIGS. 9 and 13 show rear and front view of a short sleeve shirt, which in this case differs from FIGS. 6, 7 and 8 in that the lateral aspect of the arm does not have grip material 8. Also, the absorbent material 12 extends only for a short distance (shoulder and inner/anterior bicep arm region, over the outer Acromial/shoulder region down the axillary/armpit region following down the brachial/bicep region and terminating over the antecubital/front of elbow region. The Towel/absorptive material 12 covers over the Deltoid (Anterior), Biceps Brachii, Triceps Brachii (Median)).

Figure 14:
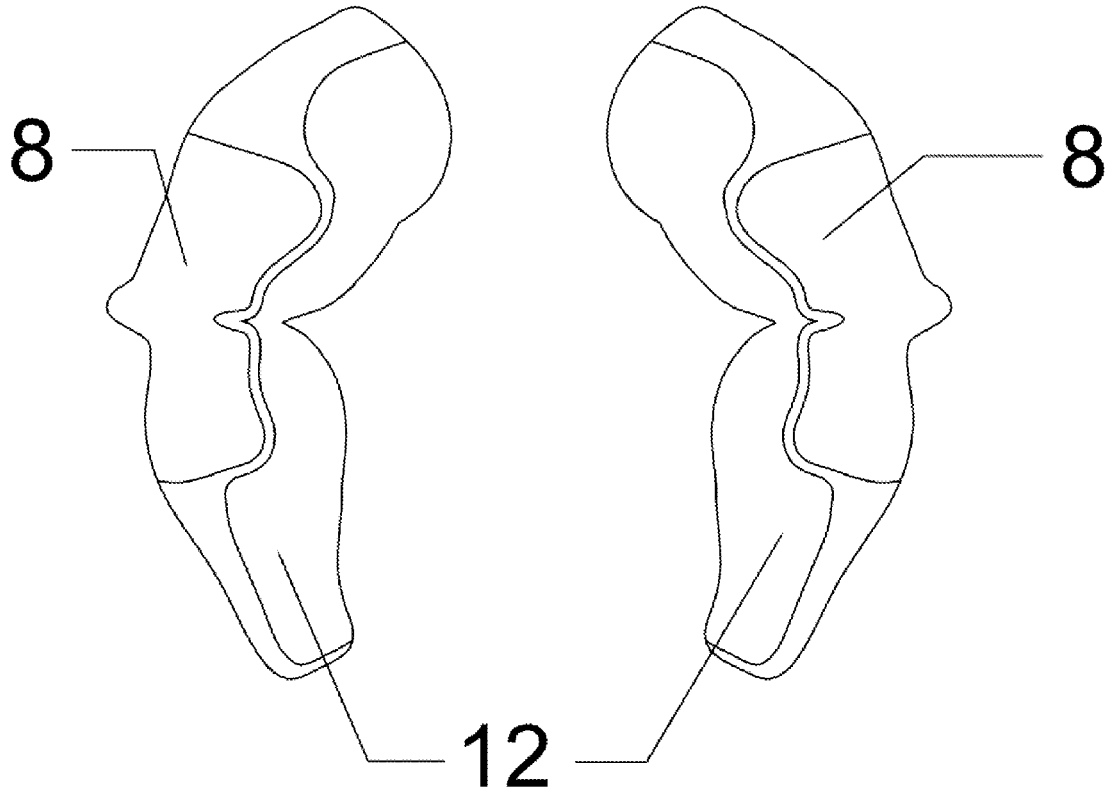
FIG. 14 shows a pair of thermal arm sleeves with grip and towel locations.

FIG. 14 shows a pair of thermal arm sleeves with grip and towel locations. These serve similar functions to the corresponding features of the shirt sleeve, with grip portions 8 (outer arm region, over the outer (Posterior) side of arm located over the Triceps, Brachii, Brachioradialis, Supinator, Extensor Carpi Ulnaris, Extensor Carpi Radialis Longus, Extensor Carpi Radialis Brevis, & Abductor Pollicis Longus muscle group area) assisting in holding poses, and being optionally padded, and absorbent material 12 portions (Shoulder & entire inner/anterior arm region (over the outer Acromial/shoulder region down the axillary/armpit region following down the brachial/bicep region and continuing over the antecubital/front of elbow and antebrachial/forearm region and finally terminating at the carpal/wrist region. The Towel/absorptive material 12 covers over the Deltoid (Anterior), Biceps Brachii, Triceps Brachii (Median), Extensors & Flexors of wrist and fingers Muscle Groups and terminating at the Retinaculum) being provided to help control and absorb sweating during vigorous exercise.

Figure 15:
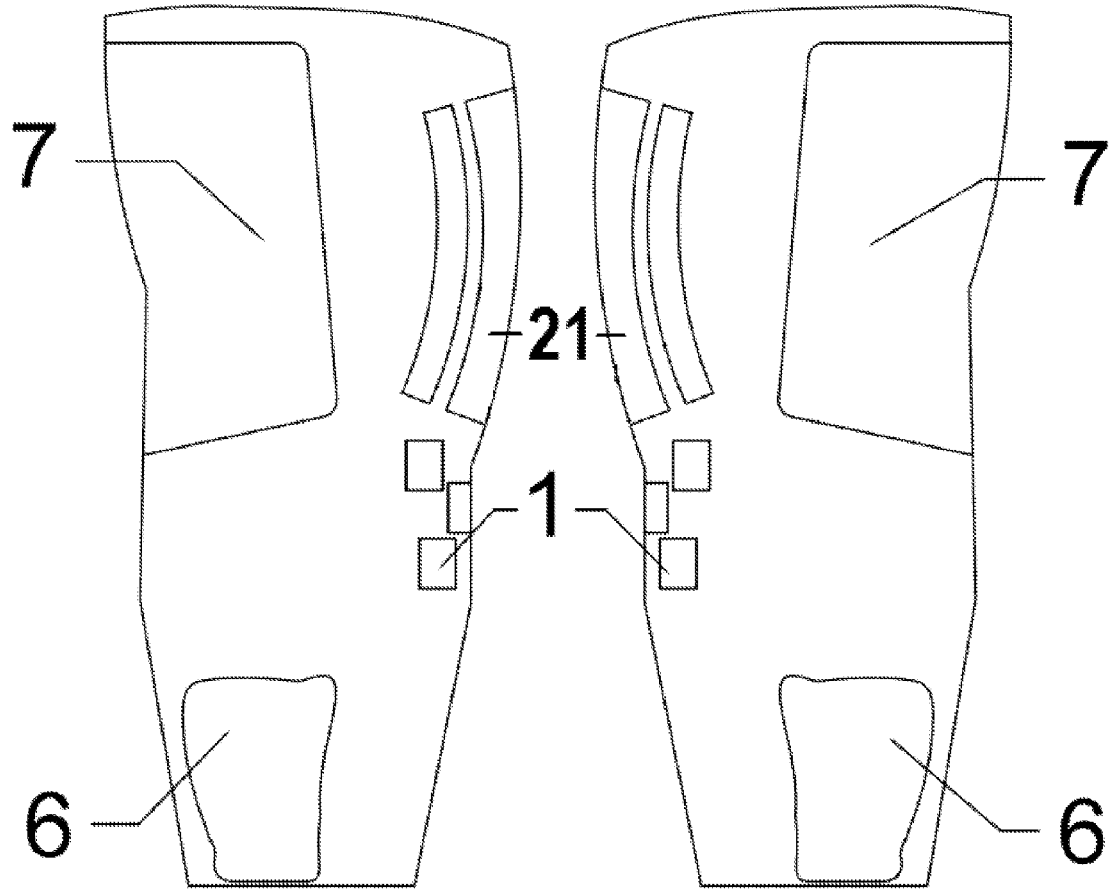
FIGS. 15, 16 and 17 show, respectively, a front, inner thigh, and rear view of thermal leg sleeves with grip locations.
Figure 16:
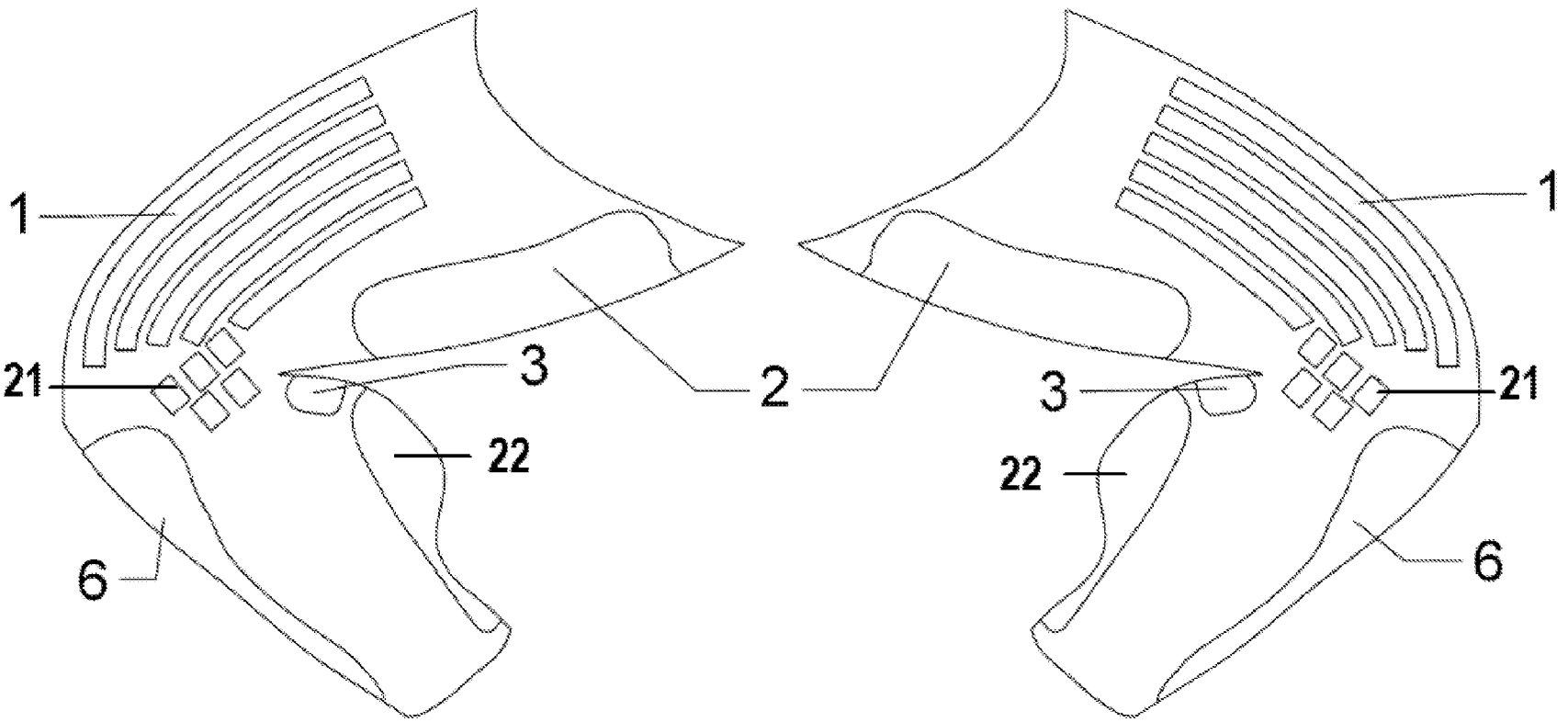
Figure 17:
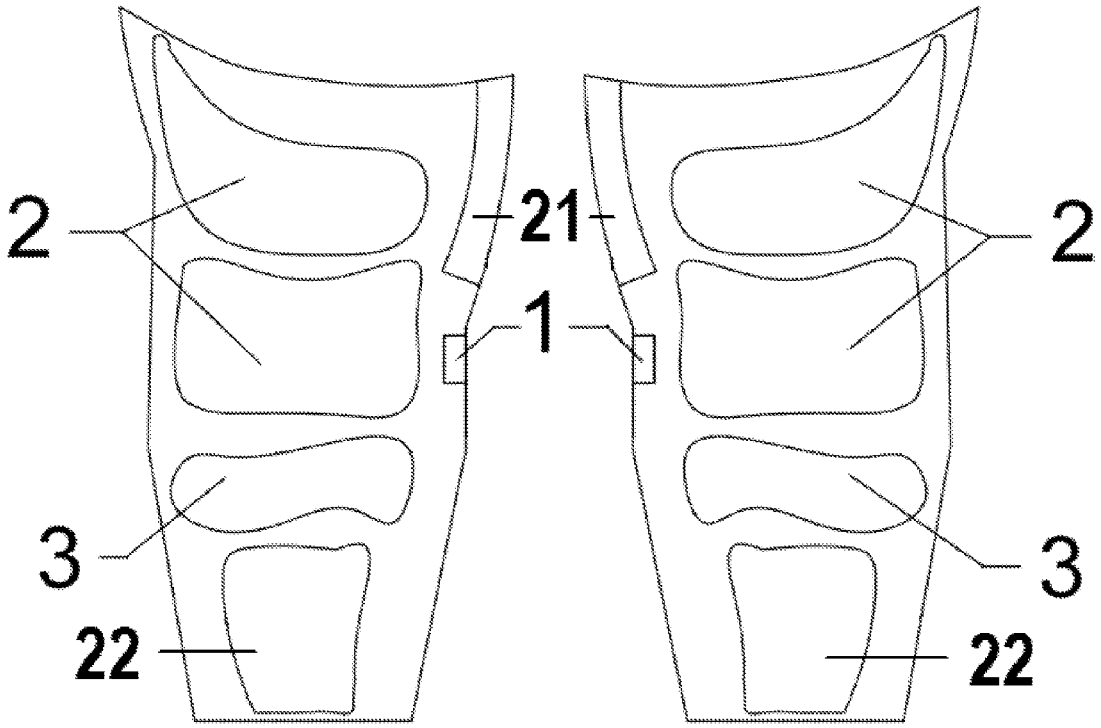

FIGS. 15, 16 and 17 show thermal leg sleeves with grip locations. Similar to Capri's legs, the thermal leg sleeves have selectively provided grip locations on the outer thigh 7 (outer thigh, over the Vastus Lateralis, Iliotibial Tract, Rectus Femoris muscle group area), inner thigh 21, hamstring area 2 (lower back of leg/Hamstring region, over the Adductor Magnus and Adductor Longus muscle group areas), rear of knee 3, calf 22 (calf and back of knee region, over the Gastrocnemius and Soleus-muscle group areas), medial aspect of knee 1 (lower)(Inner thigh (Over the Sartorius, Gracilis, and Vastus Medialis muscle group area), and knee 6 (lower front Leg/Shin area (Over the Tibialis Anterior, Extensor Digitorum Longus, Peroneus Longus, Peroneus Brevis muscle group area).

The thermal arm and leg sleeves may be formed of similar material to the pants and shirts, e.g., Spandex®, or from a heavier more thermally insulating material.

Figure 12:
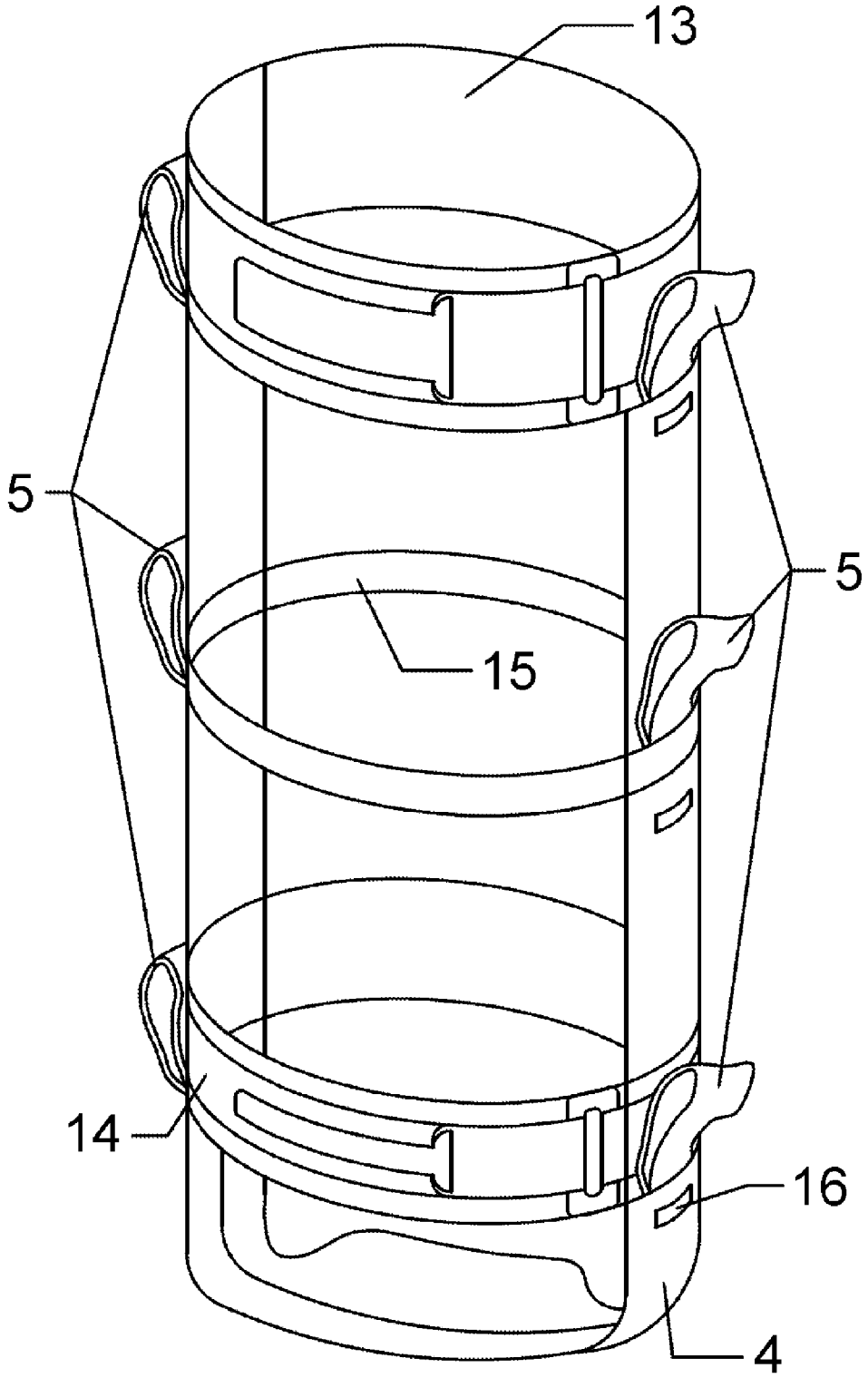
FIG. 12 shows a knee-ankle support stretching strap with heel grip and stretching loops.

FIG. 12 shows a knee-ankle support stretching strap with heel grip and stretching loops. As shown, a non-slip heel grip/stretching strap anchor 4 acts as a stirrup under the arch of the foot. Nylon stretching strap with loops 5 are provided at successive heights, anchored by the strap anchor 4. Knee brace and support strap and stretch anchor 13 is provided on the upper aspect of the support. This may be a Velcro-type attachment, which can be adjusted for a firm grip, affixed to a neoprene or other material base. The upper-most nylon stretch loop 5 is attached inside the median and outside the lateral surface of the knee brace support anchor. An ankle brace and support strap and stretch anchor 14 is provided similarly to the knee brace, 13, having a neoprene or other material base support strap with nylon and Velcro secure straps. The lower-most nylon stretch loops 5 is attached to the inside median and the outside lateral surface of the ankle brace support anchor support. The elastic band stabilizer 15 keeps the middle nylon straps 5 secure and snug against the wearers' leg. An elastic loop holder 16 secures the stretching loops 5 snug against the nylon straps, when the stretching loops 5 are not needed, and keeps them free from catching and getting caught/snagged on something.

Figure 18:
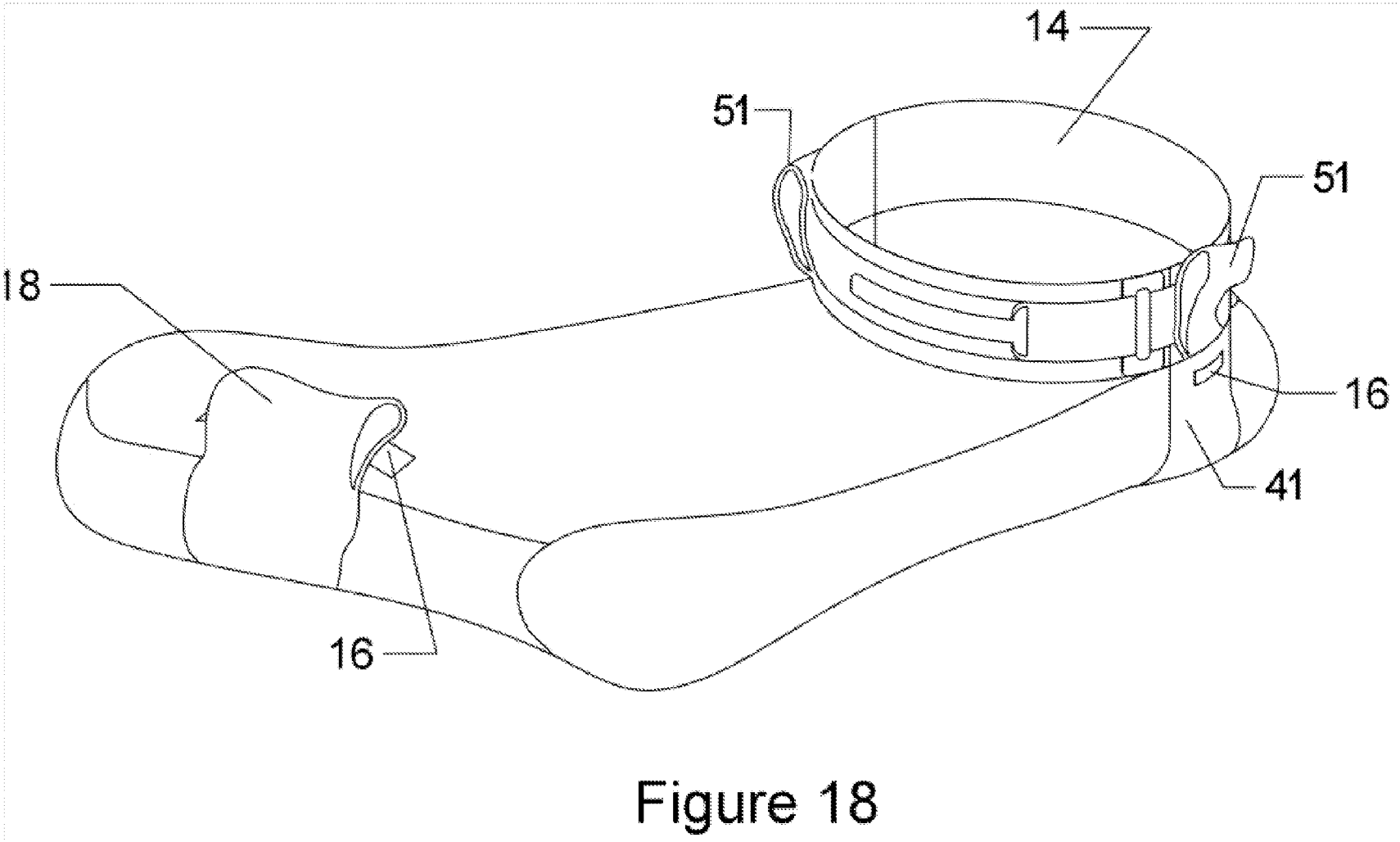
FIGS. 18 and 19 show, respectively, a side perspective view and bottom (sole) view of embodiments of a grip sock/yoga footwear with integrated ankle support and stretching loop.
Figure 19:
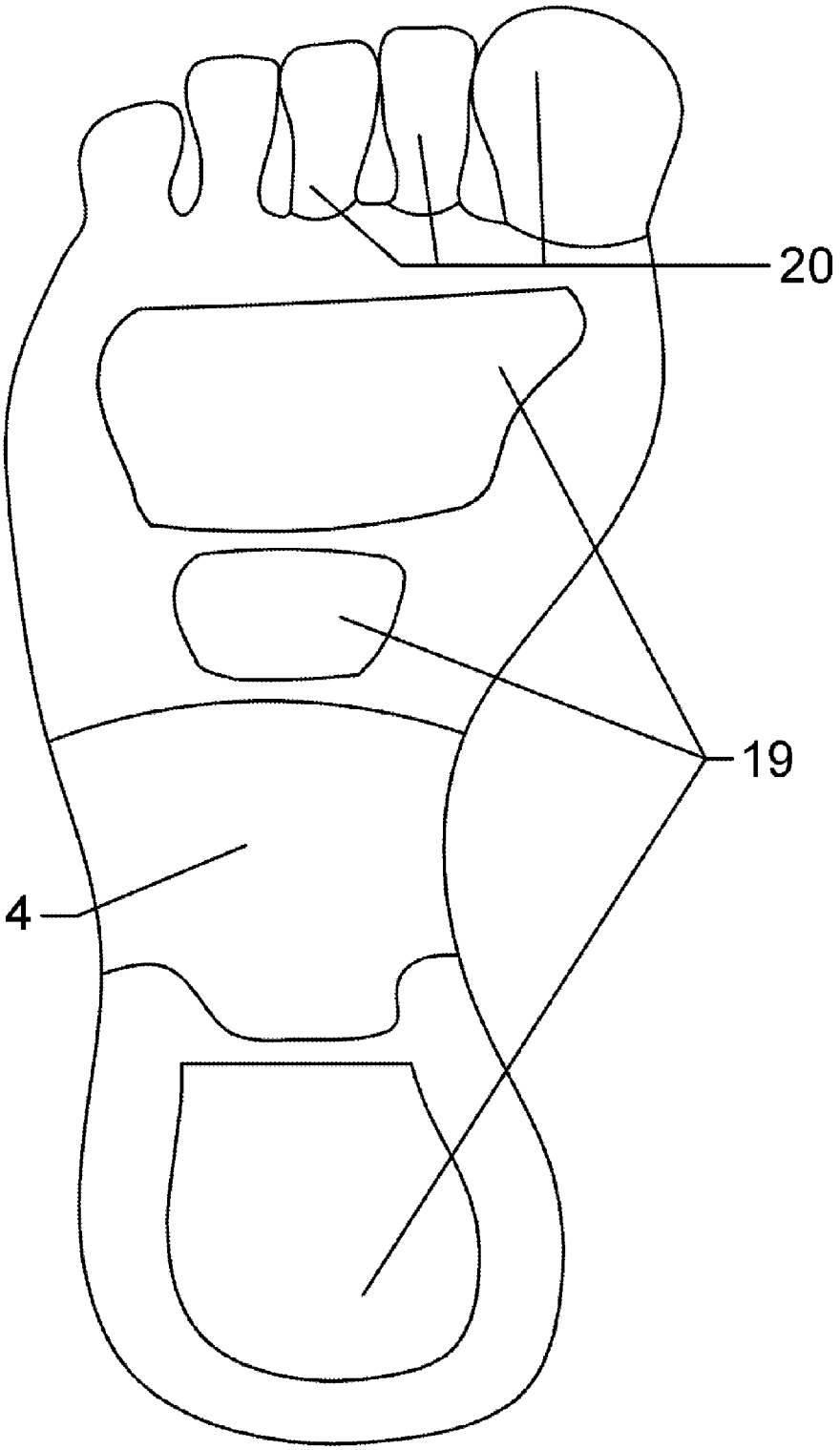

FIGS. 18 and 19 show a grip sock with integrated ankle support and stretching loop. A non-slip rubber heel grip/stretching strap anchor 41, is provided in a stirrup position below the arch. Ankle brace and support strap and stretch anchor 14 is provided as a neoprene or other material base support strap with nylon and Velcro secure straps. Similar to the knee ankle support shown in FIG. 12, a pair of nylon stretching straps with loops 51 are provided on medial and lateral aspects of the ankle brace 14. An elastic loop holder 16 is provided which secures the stretching loop 51 snug against the nylon straps when the stretching loop 51 is not needed, and keeps it free from catching and getting caught/snagged. A stretching toe loop 18, which may be formed of nylon, for example, is formed at the front tip of a footwear structure which is integral with the device. The stretching toe loop 18 is typically linked to the anchor 41 with non-compliant (e.g., non-stretching) material. A non-slip sole/foot grips 19 are provided on the bottom of the sole for traction. Likewise, a non-slip rubber toe grip 20 region is provided on at least some of the toes.

While shown in the figures in generally geometric shapes, the non slip grip portions may be pressed in arbitrary shapes and color (butterflies, flowers, clouds, trees, animals, scenery or pictures), or characters, e.g., Chinese characters, and may be presented as words or sayings.

The non-slip strips are typically provided to increase the coefficient of friction of the surface in the region of interest to be greater than the typical clothing worn while working out or doing yoga. Indeed, in many cases, the difference in frictional coefficient over various regions may be more important than the absolute values.

In the above description numerous specific details are set forth in order to provide a more thorough understanding of the present invention. It will be obvious, however, to one skilled in the art that the present invention may be practiced without these details. In other instances, well known process and materials have not been described in detail in order to not unnecessarily obscure the present invention.

Given the variety of embodiments of the present invention just described, the above description and illustrations show not be taken as limiting the scope of the present invention defined by the claims.

While the invention has been particularly shown and described with reference to the preferred embodiments thereof, it will be understood by those skilled in the art that various changes in form and details may be made without departing from the spirit and scope of the invention. It is intended to cover various modifications and similar arrangements and procedures, and the scope of the appended claims therefore should be accorded the broadest interpretation so as to encompass all such modifications and similar arrangements and procedures.

What is claimed is:

1. An article of clothing for a human, comprising:

at least one tubular leg structure configured to surround a leg of a wearer, formed of a breathable and stretchable fabric having a smooth low friction surface;

a strap within each tubular structure, configured to extend from at least a region lateral to an ankle of the wearer, beneath the sole of the foot, and back to at least a region medial to the ankle of the wearer, and being further configured to permit grasping of the strap for stretching of muscles within the leg of the human wearer; and at least one portion on an outer surface of the tubular leg structure, having a coefficient of friction with respect to the smooth low friction surface of the fabric which is at least double a respective coefficient of friction of the smooth low friction surface of the fabric against itself, selectively formed at least at a contact position of the leg of the wearer against another portion of the wearer during a Yoga exercise, wherein the strap further comprises a non-slip rubber heel grip with narrow nylon stretching strap with loops, attached on an inner surface of the at least one tubular leg structure, at medial and lateral seams, wherein said loops protrude through and are exposed at an outer surface of the at least one tubular leg structure.

2. The article of claim 1, configured as at least one of pants, Capri pants, a legging, and a knee brace.

3. The article of claim 1, wherein the at least one portion is formed on each of a pair of corresponding contact positions of the wearer during a Yoga exercise.

4. The article of claim 1, further comprising at least one padded portion on at least an inner thigh of a pants leg configured to distribute a contact load.

5. The article of claim 1, wherein the at least one portion comprises foamed elastomer having a textured exposed surface.

6. The article of claim 1, wherein the at least one portion on an outer surface of the tubular leg structure comprises padding material selectively formed in a pattern corresponding to at least one muscle group of the human leg, configured to distribute contact loads of the at least two portions of the wearer.

7. The article of claim 1, wherein the at least one portion comprises a plurality of spaced portions proximate to the contact position, wherein the plurality of spaced portions are separated by fabric absent the at least one portion having a coefficient of friction with respect to the smooth low friction surface of the fabric which is at least double a respective coefficient of friction of the smooth low friction surface of the fabric against itself.

8. The article of claim 1, wherein the article comprises pants for a wearer, with the at least one portion being provided in a bilaterally symmetric configuration at contact positions provided on regions of the pants corresponding to inner thighs of the wearer over the Sartorius, Gracilis, and Vastus Medialis muscle group area, on the outer thighs of the wearer over the Vastus Lateralis, Iliotibial Tract, Rectus Femoris muscle group area, and on the lower back of legs-calfs and popliteal fossa of the wearer over the Gastrocnemius and Soleus-Adductor Magnus and Adductor Longus muscle group areas.

9. The article of claim 1, wherein the at least one portion comprises a pattern of padding corresponding to at least one muscle of the wearer adapted to distribute contact loads.

10. The article of claim 1, wherein the at least one portion is provided in a bilaterally symmetric configuration at respective contact positions provided on the inner thighs of the wearer over at least the Sartorius, Gracilis, Vastus Medialis and Adductor Magnus muscle group areas, and on the outer thighs of the wearer over the Vastus Lateralis, Iliotibial Tract, Rectus Femoris muscle group areas.

11. An article of clothing, comprising:

at least one tubular structure configured to surround a human leg formed of a breathable and stretchable fabric having a smooth low friction surface;

at least one strap, configured to be anchored to the leg of the wearer and extending from at least a region lateral to an ankle of the wearer, beneath the sole of the foot, and back to at least a region medial to the ankle of the wearer, and being further configured to permit stretching of muscles within the human leg by grasping of the strap; and at least one portion on an outer surface of the tubular structure, having a coefficient of friction with respect to the smooth low friction surface which is at least double a respective coefficient of friction of the smooth low friction surface of the fabric against itself, formed at a potential contact position of two portions of the wearer during a Yoga exercise, wherein the at least one strap further comprises a non-slip rubber heel grip with narrow nylon stretching strap with loops, attached on an inner surface of the at least one tubular structure, at medial and lateral seams, wherein said loops protrude through and are exposed at an outer surface of the at least one tubular structure.

12. The article of claim 11, wherein the at least one portion comprises a pattern of frictional padding material corresponding to at least one muscle of the wearer adapted to distribute contact loads of the at least two portions of the wearer.

13. The article according to claim 11, comprising pants having a waist region, and two leg sections, said pants comprising mirror image locations, with respect to a median line, of the at least one portion comprising non-slip frictional grip areas, forming a frictional surface extending above the outside surface of said pants, adapted to resist a sliding movement of a contacting object.

14. The article according to claim 13, wherein the pants legs have a length extending down a leg of a wearer to at least a mid-calf region, each leg having the friction grip on at least its inner thigh region, outer thigh region, lower back of leg-calf and back of knee region, and Lower front Leg/Shin region.

15. The article of clothing according to claim 11, wherein the fabric comprises polyester-polyurethane copolymer fibers formed into an article of clothing, and the at least one portion comprises molded regions of an elastomer on an exterior surface of the fabric.

16. An article of clothing, comprising:

a fabric forming a tubular structure conforming to a human leg;

at least one strap, configured to be anchored to the leg of the wearer at or below the knee of the human leg, and being configured to extend from beneath the sole of the foot, to permit stretching of muscles within the human leg by grasping and stretching of the strap; and a permanently affixed material, formed on an outside surface of the fabric, positioned at a region of contact during an anatomical pose of the wearer, wherein a frictional coefficient of the outside surface of the fabric rubbing against an outside surface of the permanently affixed material has a lower frictional coefficient than the permanently affixed material rubbing against the permanently affixed material, such that a force parallel to the outside surface of the fabric by the wearer with the permanently affixed material proximate to the outside surface of the fabric permits ease of sliding to achieve a yoga pose, and when the permanently affixed material is rubbing against the permanently affixed material with a force applied by the wearer between the respective surfaces of the permanently affixed material, a sufficient frictional force is present to assist the wearer in holding the yoga pose without continued exertion of forces parallel to the surface of the permanently affixed material, wherein the at least one strap further comprises a non-slip rubber heel grip with narrow nylon stretching strap with loops, attached on an inner surface of the tubular structure, at medial and lateral seams, wherein said loops protrude through and are exposed at an outer surface of the tubular structure.

17. The article according to claim 16, wherein the permanently affixed material is formed at least on an outer thigh region of the article of clothing.

18. The article according to claim 16, wherein the permanently affixed material comprises an elastomer, and the fabric comprises elastane fibers.

19. The article according to claim 16, wherein the permanently affixed material comprises padding material selectively formed in a pattern corresponding to at least one muscle group of the human leg, adapted to distribute contact loads of the at least two portions of the wearer.

20. The article according to claim 16, wherein the at least one strap further comprises a set of graspable loops, attached on an inner surface of the tubular structure, at medial and lateral seams, wherein said graspable loops protrude through and are exposed at an outer surface of the tubular structure.

* * * * *